United States Patent [19]

Takahashi et al.

[11] Patent Number: 4,797,349

[45] Date of Patent: Jan. 10, 1989

[54] METHOD FOR FORMING A COLOR IMAGE COMPRISING DEVELOPING A LIGHT SENSITIVE MATERIAL CONTAINING A SURFACTANT WITH A DEVELOPER NOT CONTAINING BENZYL ALCOHOL

[75] Inventors: Osamu Takahashi; Tadashi Ogawa; Minoru Sakai; Masaharu Toriuchi, all of Kanagawa, Japan

[73] Assignee: Fuji Photo Film Co., Ltd., Kanagawa, Japan

[21] Appl. No.: 39,203

[22] Filed: Apr. 16, 1987

[30] Foreign Application Priority Data

Apr. 16, 1986 [JP] Japan ..... 61-85857

[51] Int. Cl.[4] ..... G03C 7/30

[52] U.S. Cl. ..... 430/372; 430/380; 430/434; 430/435; 430/464; 430/467; 430/631; 430/635; 430/636

[58] Field of Search ..... 430/371, 372, 380, 393, 430/464, 467, 631, 635, 636, 434, 435

[56] References Cited

U.S. PATENT DOCUMENTS

| | | | |
|---|---|---|---|
| 3,948,663 | 4/1976 | Shiba et al. | 430/505 |
| 3,996,054 | 12/1976 | Santema et al. | 430/377 |
| 4,080,209 | 3/1978 | Mukanoki et al. | 430/546 |
| 4,119,465 | 10/1978 | Matsuda et al. | 430/636 |
| 4,367,283 | 1/1983 | Nakayama et al. | 430/636 |
| 4,444,876 | 4/1984 | Maekawa et al. | 430/636 |

FOREIGN PATENT DOCUMENTS

| | | | |
|---|---|---|---|
| 737833 | 8/1968 | France | 430/636 |
| 158446 | 9/1985 | Japan | 430/464 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method for forming a color image which comprises imagewise exposing a color photographic material comprising a reflective support having thereon at least one photosensitive layer containing a color coupler capable of forming a dye image through its coupling reaction with an oxidation product of an aromatic primary amine color developing agent and a silver halide emulsion and processing it with a color developing solution containing substantially no benzyl alcohol, wherein the color development is carried out under the condition that a substantially colorless anionic surface active agent having an unsubstituted aliphatic group, a substituted aliphatic group excluding a fluorine-substituted aliphatic group, or an unsubstituted or substituted aromatic group as a hydrophobic group; and $—SO_3M$, $—SO_2M$, $—OSO_3M$, or $—OSO_2M$, wherein M represents a hydrogen atom or a metallic atom or atomic group capable of being a cation, as a hydrophilic group in the molecule thereof is present in the photosensitive layer in an amount within a range of from 0.1 to 3 times the total weight of the color couplers applied in the photosensitive layer during the color development.

11 Claims, No Drawings

METHOD FOR FORMING A COLOR IMAGE COMPRISING DEVELOPING A LIGHT SENSITIVE MATERIAL CONTAINING A SURFACTANT WITH A DEVELOPER NOT CONTAINING BENZYL ALCOHOL

FIELD OF THE INVENTION

The present invention relates to a method for forming a color image using a silver halide color photographic material and, in particular, to a method for forming a color image showing high color development properties even with a color developing solution containing no benzyl alcohol.

BACKGROUND OF THE INVENTION

A standard processing step for a silver halide color photosensitive material comprises, in general, a color developing process to form a color image, a desilvering process to remove developed or non-developed silver, and a washing process with water and/or an image stabilization process.

Hitherto, it has been attempted to reduce the processing time required for the silver halide color photosensitive material. In recent years, however, necessity of reduction in the processing time has been further increased by demands for reduction in the time limits of finish and delivery, for alleviation of laboratory work, and for miniaturization of processing system and simplification in operation of processing system for a small-scale laboratory often referred to as a miniature laboratory.

Hitherto, various penetrating agents for color developing agent have been studied in color development of silver halide color photosensitive material using an oil protect-type coupler in order to increase color development properties of the photosensitive material. In particular, a method to add benzyl alcohol to a color developing solution has been found to have a large effect on accelerating color development, and this method is now in wide use for color paper, color reversal paper, color positive film for display, and the like.

However, since benzyl alcohol has low water solubility, a solvent such as diethylene glycol, triethylene glycol, an alkanolamine, or the like is needed for its easy solubility in water. Each of these compounds including benzyl alcohol has large BOD (biological oxygen demand) and COD (chemical oxygen demand) values, which show the environmetal pollution load, so that it is desirable from the viewpoint of environmental protection to remove these compounds.

Further, since dissolution of benzyl alcohol in water takes a long time, it is better from the viewpoint of reduction in preparation work for a color developing solution to avoid use of benzyl alcohol.

In addition, when benzyl alcohol is carried over into a bleaching bath or bleach-fixing bath which is a subsequent bath, formation of a leuco dye by a cyan dye is caused and a lowering in coloring density is also caused. Further, storage properties of images of photosensitive materials after being after-treated are sometimes adversely affected by benzyl alcohol because of retardation in washing-out speed for components of the developing solution. Therefore, it is preferred also for these reasons to avoid use of benzyl alcohol.

Hitherto, it has been conventional that a color development processing takes 3 to 4 minutes, but in recent years, a reduction in processing time for color development has been demanded with the aim of reduction of the time limit of finish and delivery and of reduction of laboratory work.

However, if benzyl alcohol, which is a color development accelerator, is removed and if the development time is also reduced, a marked lowering in coloring density is inevitably caused.

To solve this problem, various color development accelerators (such as compounds as mentioned, for example, in U.S. Pat. Nos. 2,950,970, 2,515,147, 2,496,903, 2,304,925, 4,038,075, and 4,119,462; British Pat. Nos. 1,430,998 and 1,455,413; Japanese patent application (OPI) Nos. 15831/78, 624050/80, 62451/80, 62452/80, and 62453/80 the term "OPI" as used herein means "unexamined published patent application"); and Japanese Patent Publication Nos. 12422/76 and 49728/80 have been used in combination, but fully sufficient coloring density has not been obtained.

If a method using a photographic material containing 3-pyrazolidones (for example, methods as mentioned in Japanese patent application (OPI) Nos. 26338/85, 158444/85, and 158446/85) is used, it has a defect that the sensitivity is lowered with a lapse of time, or fogs are formed.

Further, if a method using a photographic material containing a color developing agent (for example, methods as mentioned in U.S. Pat. Nos. 3,719,492, 3,342,559, and 3,342,597 and Japanese patent application (OPI) Nos. 6235/81, 16133/81, 97531/82, and 83565/82) is used, it has defects such as retarded color development, formation of fogs, and the like, so that it is not an appropriate method.

All the above-mentioned methods have insufficient color development properties when substantially no benzyl alcohol is contained in the color developing solution. Also, none of such methods can provide stable photographic characteristics in a continuous processing or in the case that the development time is reduced.

SUMMARY OF THE INVENTION

An object of the invention is to provide a color image forming methot to treat stably a color photosensitive material using an oil soluble-type coupler with a color developing solution containing substantially no benzyl alcohol and further a color image forming method providing high color development properties in such color development.

This object of the invention can be attained by a method for forming a color image which comprises imagewise exposing a color photographic material comprising a reflective support having thereon at least one photosensitive layer containing a color coupler capable of forming a dye image through its coupling reaction with an oxidation product of an aromatic primary amine color developing agent and a silver halide emulsion and processing it with a color developing solution containing substantially no benzyl alcohol, wherein the color development is carried out under the condition that a substantially colorless anionic surface active agent having an unsubstituted aliphatic group, a substituted aliphatic group excluding a fluorine-substituted aliphatic group, or an unsubstituted or substituted aromatic group as a hydrophobic group; and $—SO_3M$, $—SO_2M$, $—OSO_3M$, or $—OSO_2M$, wherein M represents a hydrogen atom or a metallic atom or atomic group capable of being a cation, as a hydrophilic group in the molecule thereof is present in the photosensitive layer in an amount within a range of from 0.1 to 3 times the total weight of the color couplers applied in the photosensitive layer during the color development.

DETAILED DESCRIPTION OF THE INVENTION

Preferred embodiments in the invention include the following.

(1) The above-mentioned method for forming a color image in which the amount of the anionic surface active agent present in the photosensitive layer during the color development is within a range of from 0.15 to 2.5 times the total weight of the color couplers.

(2) The above-mentioned method for forming a color image in which the amount of the anionic surface active agent present in the photosensitive layer during the color development is within a range of from 0.2 to 2 times the total weight of the color couplers.

(3) The above-mentioned method for forming a color image in which at least one anionic surface active agent present in the photosensitive layer during the color development is a compound represented by formula (I)

$$R_1—(CH_2CH_2O)_m(CH_2)_n—(X)_l \quad (I)$$

wherein $R_1$ represents a hydrogen atom or a substituted or unsubstituted alkyl, aryl, alkoxy, aryloxy, alkylthio, or arylthio group, provided that said group is not a fluorine-substituted alkyl group or a fluorine-substituted alkoxy group; X represents $—SO_3M$, $—SO_2M$, $—OSO_3M$, or $—OSO_2M$, wherein M represents a hydrogen atom or a metallic atom or atomic group capable of being a cation; m and n each represents an integer of from 0 to 30; and l represents 1 or 2.

(4) The above-mentioned method for forming a color image in which at least one anionic surface active agent present in the photosensitive layer during the color development is a compound represented by formula (II)

$$R_2—\underset{\underset{O}{\|}}{C}—\underset{\underset{R_3}{|}}{N}—(CH_2CH_2O)_m(CH_2)_n—X \quad (II)$$

wherein $R_2$ and $R_3$ each represents a hydrogen atom or a substituted or unsubstituted alkyl or aryl group, provided that $R_2$ and $R_3$ are not both hydrogen atoms and that $R_2$ is not a fluorine-substituted alkyl group; X represents $—SO_3M$, $—SO_2M$, $—OSO_3M$, or $—OSO_2M$, wherein M represents a hydrogen atom or a metallic atom or atomic group capable of being a cation; and m and n each represents an integer of from 0 to 30.

(5) The above-mentioned method for forming a color image in which at least one anionic surface active agent present in the photosensitive layer during the color development is a compound represented by formula (III)

$$\begin{array}{l} \quad CH_2COOR_5 \\ \quad | \\ X—CHCOOR_4 \end{array} \quad (III)$$

wherein $R_4$ and $R_5$ each represents a hydrogen atom or a substituted or unsubstituted alkyl, aryl, or aralkyl group, provided that $R_4$ and $R_5$ are not both hydrogen atoms and that neither $R_4$ nor $R_5$ is a fluorine-substituted alkyl group; and X represents $—SO_3M$, $—SO_2M$, $—OSO_3M$, or $—OSO_2M$, wherein M represents a hydrogen atom or a metallic atom or atomic group capable of being a cation.

(6) The above-mentioned method for forming a color image in which at least one anionic surface active agent present in the photosensitive layer during the color development is a compound represented by formula (IV)

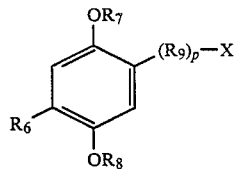

(IV)

wherein $R_6$ represents a substituted or unsubstituted alkyl, alkoxy, aromatic, or alkylthio group containing 6 or more carbon atoms; $R_7$ and $R_8$ each represents a hydrogen atom or an alkyl group containing from 1 to 18 carbon atoms; $R_9$ represents an alkylene group containing from 1 to 4 carbon atoms; p represents 0 or 1; and X represents $—SO_3M$, $—SO_2M$, $—OSO_3M$, or $—OSO_2M$, wherein M represents a hydrogen atom or a metallic atom or atomic group capable of being a cation.

Formulae (I), (II), (III), and (IV) are described in more detail hereinafter.

$$R_1—(CH_2CH_2O)_m(CH_2)_n—(X)_l \quad (I)$$

In formula (I), $R_1$ represents a hydrogen atom or a substituted or unsubstituted alkyl, aryl, alkoxy, aryloxy, alkylthio, or arylthio group, provided that a fluorine-substituted alkyl group and a fluorine-substituted alkoxy group are excluded.

If $R_1$ is a substituted or unsubstituted alkyl group, it may be linear, branched, or cyclic and also may be saturated or unsaturated. As the substituent, there may be mentioned, for example, a hydroxyl group, a halogen atom except a fluorine atom (e.g., a chlorine atom, a bromine atom, and an iodine atom), a sulfo group, a carboxyl group, an amino group, an alkyloxy group, an alkylthio group, an aryloxy group, an arylthio group, a sulfoamido group, an alkylamido group, an aldehyde group, and the like.

If $R_1$ is a substituted or unsubstituted aryl group, it represents, for example, a phenyl group, a naphthyl group, or the like. As the substituent, there may be mentioned, for example, a halogen atom, a nitro group, an amino group, a hydroxyl group, an alkyl group, a cycloalkyl group, an aryl group, an allyl group, an acyl group, an acylamino group, an acyloxy group, a carbamoyl group, a carbamoylamino group, a carbamoyloxy group, a sulfamoyl group, an alkoxy group, and the like. $R_1$ may have two or more substituents in the molecule.

If $R_1$ is a substituted or unsubstituted alkoxy group, the carbon chain thereof may be linear or branched. As the substituent, there may be mentioned, for example, an alkoxy group, a phenoxy group, a halogen atom except a fluorine atom (e.g., a chlorine atom, a bromine atom, and an iodine atom, specially a chlorine atom), an amino group, and the like.

If $R_1$ is a substituted or unsubstituted aryloxy group, it represents, for example, a phenyloxy group, a naphthyloxy group, or the like. As the substituent, those as mentioned for the above-mentioned aryl group can be applied.

If $R_1$ is a substituted or unsubstituted alkylthio group, the alkyl chain thereof may be linear, branched, or cyclic. As the substituent, those as mentioned for the above-mentioned alkyl group can be applied.

If $R_1$ is a substituted or unsubstituted arylthio group, it represents, for example, a phenylthio group, a naphthylthio group, or the like. As the substituent, those as mentioned for the above-mentioned aryl group can be applied.

A preferred total number of carbon atoms constituting $R_1$ in formula (I) is from 1 to 30, and a more preferred total number of carbom atoms is from 6 to 18.

X represents $-SO_3M$, $-SO_2M$, $-OSO_3M$, or $-OSO_2M$, wherein M represents a hydrogen atom or a metallic atom or atomic group capable of being a cation; m and n each represents an integer of from 0 to 30; and l represents 1 or 2.

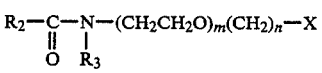

(II)

In formula (II), $R_2$ and $R_3$ each represents a hydrogen atom or a substituted or unsubstituted alkyl or aryl group, provided that $R_2$ and $R_3$ are not both hydrogen atoms and that $R_2$ is not a fluorine-substituted alkyl group; X represents $-SO_3M$, $-SO_2M$, $-OSO_3M$, or $-OSO_2M$, wherein M represents a hydrogen atom or a metallic atom or atomic group capable of being a cation; and m and n each represents an integer of from 0 to 30.

If $R_2$ is a substituted or unsubstituted alkyl group, it may be linear, branched, or cyclic and also may be saturated or unsaturated. As the substituent, there may be mentioned, for example, a hydroxyl group, a halogen atom except a fluorine atom (e.g., a chlorine atom, a bromine atom, and an iodine atom), a sulfo group, a carboxyl group, an amino group, an alkyloxy group, an alkylthio group, an aryloxy group, an arylthio group, a sulfonamido group, an alkylamido group, an aldehyde group, and the like.

If $R_3$ is a substituted or unsubstituted alkyl group, it may be linear, branched, or cyclic. As the substituent, there may be mentioned, for example, a hydroxyl group, a halogen atom, a sulfo group, a carboxyl group, an amino group, an alkyloxy group, an alkylthio group, an aryloxy group, an arylthio group, a sulfonamido group, an alkylamido group, an aldehyde group, and the like.

If $R_2$ or $R_3$ is a substituted or unsubstituted aryl group, it represents, for example, a phenyl group, a naphthyl group, or the like. As the substituent, there may be mentioned, for example, a halogen atom, a nitro group, an amino group, a hydroxyl group, an alkyl group, a cycloalkyl group, an aryl group, an allyl group, an acyl group, an acylamino group, a carbamoyl group, a sulfamoyl group, an alkoxy group, and the like. $R_2$ or $R_3$ may have two or more substituents in the molecule.

A preferred total number of carbon atoms constituting $R_2$ is from 1 to 30, and a further preferred total number of carbon atoms is from 6 to 30.

A preferred total number of carbon atoms constituting $R_3$ is from 1 to 30, and a more preferred total number of carbon atoms is from 1 to 15.

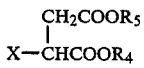

(III)

In formula (III), $R_4$ and $R_5$ each represents a hydrogen atom or a substituted or unsubstituted alkyl, aryl, or aralkyl group, provided that $R_4$ and $R_5$ are not both hydrogen atoms and that neither $R_4$ nor $R_5$ is a fluorine-substituted alkyl group. More preferably, $R_4$ and $R_5$ each represents a hydrogen atom or a substituted or unsubstituted alkyl or aryl group, provided that said group is not a fluorine-substituted alkyl group.

If $R_4$ or $R_5$ is a substituted or unsubstituted alkyl group, it may be linear, branched, or cyclic. As the substituent, there may be mentioned, for example, a hydroxyl group, a halogen atom except a fluorine atom (e.g., a chlorine atom, a bromine atom, and an iodine atom), a sulfo group, a carboxyl group, an amino group, an alkyloxy group, an alkylthio group, an aryloxy group, an arylthio group, a sulfonamido group, an alkylamido group, an aldehyde group, and the like.

If $R_4$ or $R_5$ is a substituted or unsubstituted aryl group, it represents, for example, a phenyl group, a naphthyl group, or the like. As the substituent, there may be mentioned, for example, a halogen atom, a nitro group, an amino group, a hydroxyl group, an alkyl group, a cycloalkyl group, an aryl group, an allyl group, an acyl group, an acylamino group, a carbamoyl group, a sulfamoyl group, an alkoxy group, and the like. $R_4$ or $R_5$ may have two or more substituents in the molecule.

If $R_4$ or $R_5$ is an unsubstituted aralkyl group, it represents, for example, a benzyl group, a phenethyl group, or the like; and if $R_4$ or $R_5$ is a substituted aralkyl group, as the substituent, there may be exemplified those described above for the substituted aryl group.

A preferred total number of carbon atoms constituting $R_4$ is from 1 to 30, and a more preferred total number of carbon atoms is from 4 to 15.

A preferred total number of carbon atoms constituting $R_5$ is from 1 to 30, and a more preferred total number of carbon atoms is from 4 to 15.

X represents $-SO_3M$, $-SO_2M$, $-OSO_3M$, or $-OSO_2M$, wherein M represents a hydrogen atom or a metallic atom or atomic group capable of being a cation.

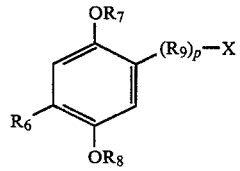

(IV)

In formula (IV), $R_6$ represents a substituted or unsubstituted alkyl, alkoxy, aromatic, or alkylthio group containing 6 or more carbon atoms; $R_7$ and $R_8$ each represents a hydrogen atom or an alkyl group containing from 1 to 18 carbon atoms; $R_9$ represents an alkylene group containing from 1 to 4 carbon atoms; p represents 0 or 1; and X represents $-SO_3M$, $-SO_2M$, $-OSO_3M$, or $-OSO_2M$, wherein M represents a hydrogen atom or a metallic atom or atomic group capable of being a cation.

If $R_6$ is a substituted or unsubstituted alkyl group, it may be linear, branched, or cyclic. As the substituent, there may be mentioned, for example, a hydroxyl group, a halogen atom, a sulfo group, a carboxyl group, an amino group, an alkyloxy group, an alkylthio group, an aryloxy group, an arylthio group, a sulfonamido group, an alkylamido group, an aldehyde group, and the like.

If $R_6$ is a substituted or unsubstituted alkoxy group, the carbon chain thereof may be linear or branched. As the substituent, there may be mentioned, for example, an alkoxy group, a phenoxy group, a halogen atom (in particular, a chlorine atom), an amino group, and the like.

If $R_6$ is a substituted or unsubstituted aromatic group, it represents, for example, a phenyl group or a substituted phenyl group. As the substituent, there may be mentioned, for example, an alkyl group, an alkoxy group, and a halogen atom.

If $R_6$ is a substituted or unsubstituted alkylthio group, the carbon chain thereof may be linear or branched. As the substituent, there may be mentioned, for example, an alkoxy group.

A preferred total number of carbon atoms constituting $R_6$ in formula (IV) is from 8 to 30, and a more preferred total number of carbon atoms is from 10 to 20.

An alkyl group represented by $R_7$ and $R_8$ may be a substituted alkyl group or an unsubstituted alkyl group, and it may be linear, branched, or cyclic. As the substituent, there may be mentioned, for example, a hydroxyl group, a halogen atom, a sulfo group, a carboxyl group, an amino group, an alkyloxy group, an alkylthio group, an aryloxy group, an arylthio group, a sulfonamido group, an alkylamido group, an aldehyde group, and the like.

A color developing solution "containing substantially no benzyl alcohol" in the invention means a color developing solution having a concentration of 2.0 ml/l or less, preferably 0.5 ml/l or less, of benzyl alcohol. A color developing solution containing no benzyl alcohol at all is more preferred. Further, use of a substantially colorless anionic surface active agent means exclusion of a spectral sensitizing agent or an irradiation-preventing dye.

If the substantially colorless anionic surface active agent used in the invention is water soluble or soluble in a water-miscible solvent, it is, in general, dissolved in water or a water-miscible solvent before it is added to an emulsion for application of photosensitive layer or to a color developing solution.

If the substantially colorless anionic surface active agent used in the invention is oil soluble, generally one or more of the surface active agents and a color coupler are, together with a hydroquinone derivative, an image stabilizer, or an ultraviolet light absorbing agent, as required, dissolved in a high boiling point organic solvent such as organic acid amides, carbamates, esters, ketones, hydrocarbons, urea derivatives, or the like or in a low boiling point organic solvent, as required, to form a solution of the surface active agent. The above-mentioned high boiling point organic solvent and low boiling point organic solvent may each be used individually or may be mixed for use. The above-mentioned solution of surface active agent is emulsified and dispersed in an aqueous medium such as an aqueous solution or an aqueous solution of gelatin with a high speed rotary mixer, a colloid mill, an ultrasonic dispersing apparatus, or the like. It is preferred that, in this process, a water soluble surface active agent is used in combination in the aqueous medium.

Substantially colorless anionic surface active agents used in the invention may each be used individually or may be mixed for use. The weight ratio of the total amount of anionic surface active agents present in the photosensitive layer during the color development to the total amount of color couplers applied to the photosensitive layer is generally within a range of from 0.1/1 to 3.0/1, preferably from 0.15/1 to 2.5/1, and more preferably of from 0.2/1 to 2.0/1. Further, the weight ratio of the amount of each of the anionic surface active agents represented by the above-mentioned formulae (I) to (IV) which are present in the photosensitive layer during the color development to the amount of color couplers applied to the photosensitive layer is within a range of from 0.01/1 to 0.4/1 for the surface active agent represented by formula (I), of from 0.01/1 to 0.4/1 for the surface active agent represented by formula (II), of from 0.01/1 to 0.4/1 for the surface active agent represented by formula (III), and from 0.05/1 to 0.20/1 for the surface active agent represented by formula (IV), respectively.

If the substantially colorless anionic surface active agent used in the invention is water soluble, it is preferably added directly to the developing solution. In this case, a preferred amount of the surface active agent added is from about 0.5 to 125 g/l of the developing solution.

The amount of the surface active agent added is affected by the amount of oil soluble couplers contained in the photosensitive layer of the photosensitive material to be developed and by the swelling thickness of a film when processed, and it is also affected by the penetration degree of the surface active agent to be used into the film. Actually, with a photosensitive material containing an oil soluble coupler, it is difficult to emulsify and disperse the coupler and the oil without use of any surface active agent, and even if the photosensitive material is processed by a method such as washing with water to remove the surface active agent from it, some part of the surface active agent used ineviably remains in the photosensitive layer. Therefore, when the photosensitive material is subjected to color development, a surface active agent supplied from the processing solution and a surface active agent carried over by the photosensitive material are present though it is difficult to determine each of the two surface active agents quantitatively. Since the amount of the surface active agent originally contained in the color developing solution is relatively small, an effect of the invention appears definitely. The above-mentioned range as to the amount of the surface active agent added can be understood easily when this respect is considered.

Further, in the case where the surface active agent is contained in a photosensitive material, in particular, when one having higher water solubility is used, the surface active agent has sometimes flowed out of the color developed layer when processed. In such a case, it is sometimes necessary to add an especially large amount of the surface active agent to the photosensitive material.

A method for dissolving a so-called oil soluble coupler in a high boiling point solvent and then emulsifying and dispersing the resulting solution in a gelatin solution with a surface active agent, in particular, an anionic surface active agent, has been known, and also has been in wide use. The anionic surface active agent used in the invention may be contained in a photosensitive material as such an emulsifying and dispersing agent, or may be added to a photosensitive material with the aim of a coating assistant or the like. It may further be added to a color developing solution without being contained in a photosensitive material. As described in U.S. Pat. No. 2,322,027, when a surface active agent is used as an emulsifying and dispersing agent, it is necessarily contained in a photosensitive material. However, any knowledge that the surface active agent has a great effect on color development properties of the oil soluble coupler has not been found. The invention relates to a technology to improve color development properties of oil soluble couplers by an effect of the surface active agent present in a photosensitive material when color development processed in a larger amount than that of the surface active agent used for usual emulsification and dispersion or used as a coating assistant. The fact that the color development properties of oil soluble couplers are substantially increased by a large amount of the surface active agent present with the couplers in a color development processing with a color developing solution containing substantially no benzyl alcohol has not been known. In particular, the fact that the color development of the coupler in the presence of a large amount of the surface active agent with a color developing solution containing benzyl alcohol not only hardly contributes to color development properties of the coupler, but also rather sometimes lowers coloring density of the coupler and, on the contrary to this, the color development of the coupler in the presence of a large amount of the surface active agent with a color developing solution containing substantially no benzyl alcohol substantially increases color development properties of the coupler has not been known. Such a technology on oil soluble couplers is a thoroughly novel technology which cannot be forecast from the conventional technology.

Such a technology which enables an improvement in color development properties of the coupler without using benzyl alcohol has great usefulness from the viewpoint of the production or development of photosensitive materials and of problems such as workability and environmental pollution related thereto.

Hitherto, there are few photosensitive materials having a definitely prescribed amount of a surface active agent used and a photosensitive material having a prescribed large amount of a surface active agent used as in the invention has not been known.

On the other hand, when the amount of the surface active agent used is increased beyond the range of the invention, adverse influences, such as deterioration in film physical properties of the photosensitive material, unsharpness of dye image, deterioration in sharpness of image, and the like, appear so that the above-mentioned range as to the surface active agent used in the invention is prescribed.

Synthetic methods of substantially colorless anionic surface active agents used in the invention are described in detail in books and literatures as set forth below, and the surface active agents used in the invention can be synthesized in conformity with these synthetic methods.

(1) *Synthesis and Application of Surface Active Agents,* by Ryohei Oda and Kazuhiro Teramura (published by Maki Book Co. (1957))

(2) *Surface Active Agents,* by A. W. Perry (Interscience Publications Inc., New York)

(3) *General Synthetic Methods of Sulfinic Acids,* by S. R. Sandler and W. Karo (4) *Organic Functional Group Preparations,* p. 519 (Academic Press (1968))

Specific examples of substantially colorless anionic surface active agents used according to this invention are set forth below, but the invention is not limited to these examples.

$C_{12}H_{25}SO_3Na$ (1)

$C_8H_{17}OCH_2CH_2SO_3Na$ (2)

$C_{12}H_{25}O(CH_2)_4SO_3Na$ (3)

$C_{16}H_{33}O(CH_2)_3SO_3Na$ (4)

$C_{11}H_{23}CONHCH_2CH_2SO_3Na$ (5)

$C_{17}H_{33}CONHCH_2CH_2SO_3Na$ (6)

$C_{17}H_{35}CONHCH_2CH_2SO_3Na$ (7)

$C_{17}H_{35}CONHCH_2CH_2SO_3H$ (8)

$C_{17}H_{33}CONH(CH_2)_3SO_2Na$ (9)

$C_{17}H_{33}CONH(CH_2)_4SO_3Na$ (10)

$C_{17}H_{33}CON(CH_3)CH_2CH_2SO_3Na$ (11)

$CH_3CON(C_{12}H_{25})-CH_2CH_2SO_3Na$ (12)

$C_{12}H_{25}CONHCH_2CH_2SO_3Na$ (13)

$NaO_3S_5(CH_2)_3O(C_3H_6O)_n(CH_2)_3SO_3Na$ (14)
n = 11.8

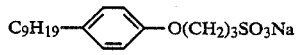
(15)

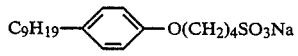
(16)

$C_{12}H_{25}CH{=}CHSO_3Na$ (17)

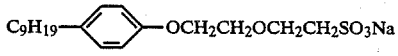
(18)

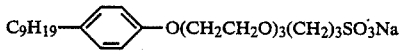
(19)

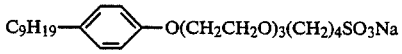
(20)

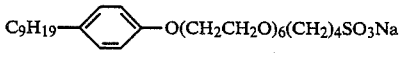
(21)

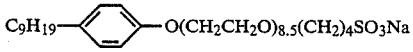
(22)

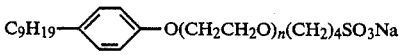
(23)
n = 10

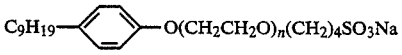
(24)
n = 15

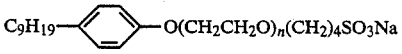
(25)
n = 20

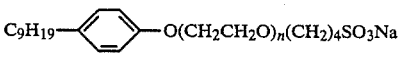
(26)
n = 30

-continued
(27)
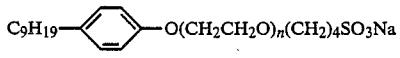
n = 50
(28)
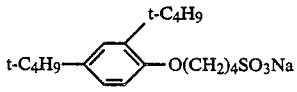
(29)
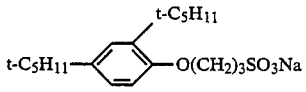
(30)
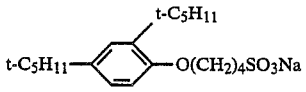
(31)
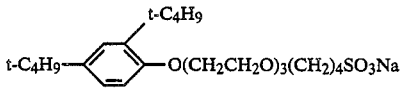
(32)
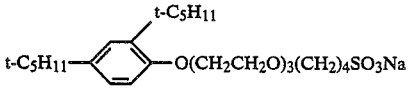
(33)
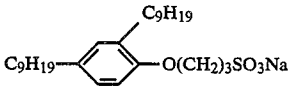
(34)
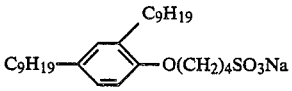
(35)
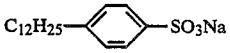
(36)
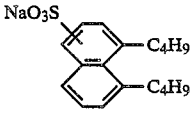
(37)
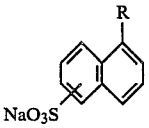
R: $C_{12}H_{25}$
(38)
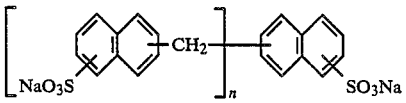
n = 4~7
(39)
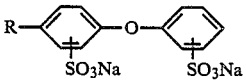
R: mixture of $C_9H_{19}$ and $C_{10}H_{21}$
(40)
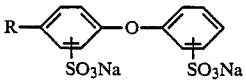
R: $C_{12}H_{25}$
-continued
(41)
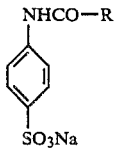
R: $C_9H_{19}$
(42)
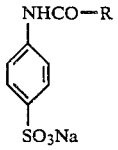
R: $C_{11}H_{22}$
(43)
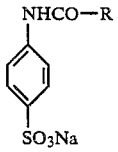
R: $C_{17}H_{35}$
(44)
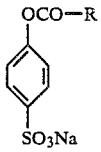
R: $C_9H_{19}$
(45)
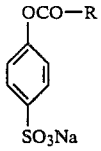
R: $C_{11}H_{23}$
(46)
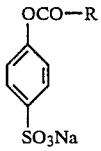
R: $C_{17}H_{35}$
(47)
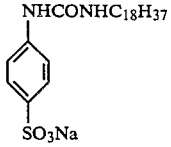
(48)
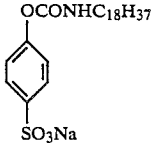
(49)
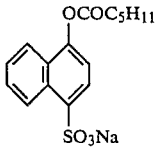

-continued
(50)
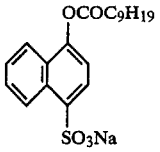
(51)
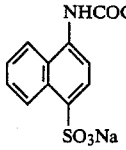
(52)
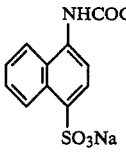
(53)
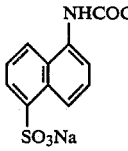
(54)
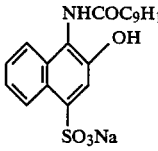
(55)
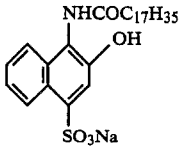
(56)
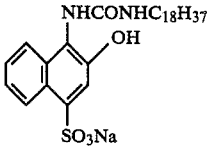
(57)
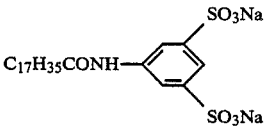
(58)
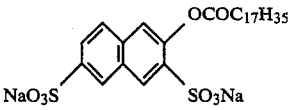
(59)
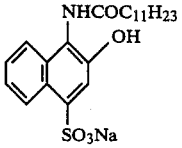
-continued
(60)
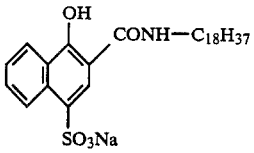
(61)
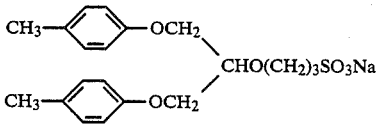
(62)
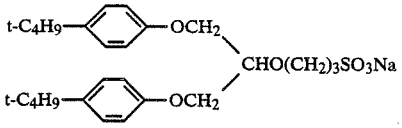
(63)
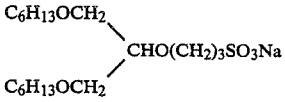
(64)
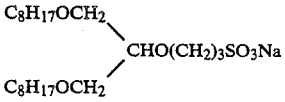
(65)
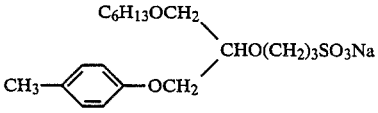
(66)
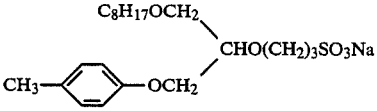
(67)
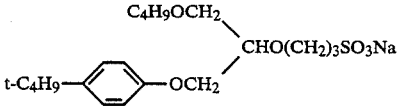
(68)
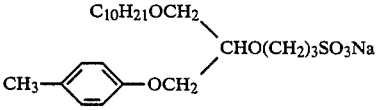
(69)
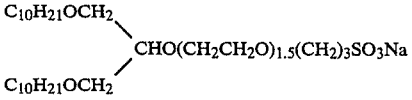
(70)
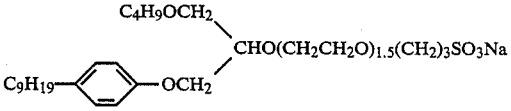
(71)
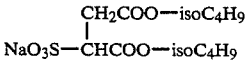
(72)
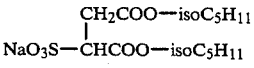

-continued (73)

$$\begin{array}{l} CH_2COOC_6H_{13}-n \\ | \\ NaO_3S-CHCOOC_6H_{13}-n \end{array}$$

(74)

$$\begin{array}{l} \qquad\qquad\qquad\qquad CH_3 \\ \qquad\qquad\qquad\qquad | \\ CH_2COOCH_2CH_2CHCH_2CH_2CH_3 \\ | \\ NaO_3S-CHCOOCH_2CH_2CHCH_2CH_2CH_3 \\ \qquad\qquad\qquad\qquad | \\ \qquad\qquad\qquad\qquad CH_3 \end{array}$$

(75)

$$\begin{array}{l} CH_2COO-CH_2CH(C_2H_5)C_4H_9 \\ | \\ NaO_3S-CHCOO-CH_2CH(C_2H_5)C_4H_9 \end{array}$$

(76)

$$\begin{array}{l} CH_2COOC_8H_{17}-n \\ | \\ NaO_3S-CHCOOC_8H_{17}-n \end{array}$$

(77)

$$\begin{array}{l} CH_2COOC_9H_{19}-n \\ | \\ NaO_3S-CHCOOC_9H_{19}-n \end{array}$$

(78)

$$\begin{array}{l} \qquad\qquad\qquad\qquad CH_3 \quad CH_3 \\ \qquad\qquad\qquad\qquad | \qquad | \\ CH_2COOCH_2CH_2CHCH_2-C-CH_3 \\ | \qquad\qquad\qquad\qquad\qquad\qquad | \\ \qquad\qquad\qquad\qquad\qquad\qquad CH_3 \\ \qquad\qquad\qquad\qquad\qquad\qquad CH_3 \\ \qquad\qquad\qquad\qquad\qquad\qquad | \\ NaO_3S-CHCOOCH_2CH_2CHCH_2-C-CH_3 \\ \qquad\qquad\qquad\qquad\qquad\qquad | \qquad | \\ \qquad\qquad\qquad\qquad\qquad\qquad CH_3 \quad CH_3 \end{array}$$

(79)

$$\begin{array}{l} CH_2COOC_{10}H_{21}-n \\ | \\ NaO_3S-CHCOOC_{10}H_{21}-n \end{array}$$

(80) $C_8H_{17}SO_3Na$

(81) $C_4H_9CH(C_2H_5)CH_2OSO_3Na$

(82) $C_{12}H_{25}OSO_3Na$

(83) $C_{14}H_{29}OSO_3Na$

(84) $C_{16}H_{33}OSO_3Na$

(85) $C_{18}H_{37}OSO_3Na$

(86) $C_{17}H_{35}OSO_3Na$ (87)

$$\begin{array}{l} C_4H_9CH(C_2H_5)C_2H_4CHCH_2CH(CH_3)_2 \\ \qquad\qquad\qquad\qquad | \\ \qquad\qquad\qquad\qquad OSO_3Na \end{array}$$

(88)

$$\begin{array}{l} C_4H_9CH(C_2H_5)C_2H_4CH-C_2H_4CH(C_2H_5)_2 \\ \qquad\qquad\qquad\qquad | \\ \qquad\qquad\qquad\qquad OSO_3Na \end{array}$$

(89)

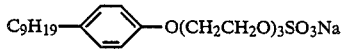

(90)

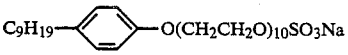

(91)

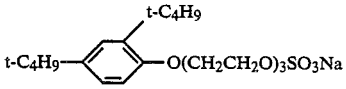

(92)

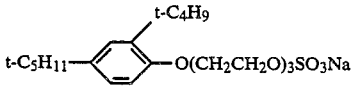

(93) $NaO_3S-O(C_3H_6O)_nSO_3Na$

(94) $NaO_3SO(C_3H_6O)_{17.5}SO_3Na$

(95) $NaO_3SO(C_3H_6O)_{35}SO_3Na$

(96) $NaO_3SO(C_3H_6O)_{13}SO_3Na$

(97) $NaO_3SO(C_3H_6O)_{6.9}SO_3Na$

(98) $NaO_3SO(CH_2CH_2O)_nCH_2CH_2OSO_3Na$
n = 8

(99) $C_{17}H_{35}CONHCH_2CH_2OSO_3Na$ (100) $C_{17}H_{33}CONHCH_2CH_2OSO_3Na$

-continued (101)

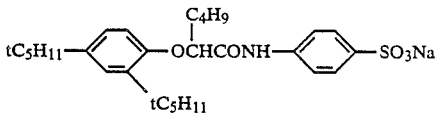

(102)

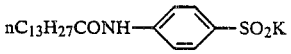

(103)

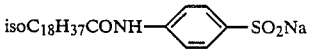

(104)

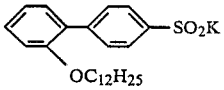

(105)

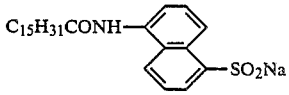

(106)

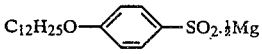

(107)

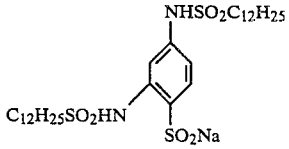

(108)

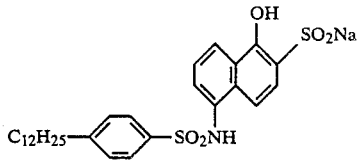

(109)

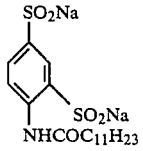

(110)

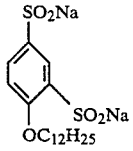

(111)

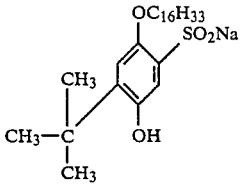

(112)

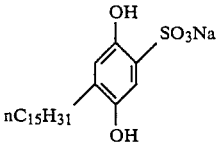

-continued

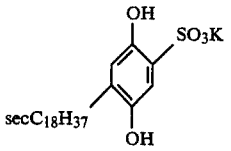

(113)

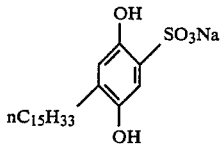

(114)

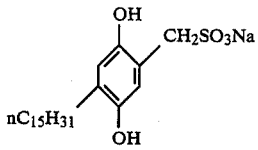

(115)

The compounds of the invention may be used singly or as a combination thereof, but it is preferred to combine two or more compounds.

A reflective support which can be used in the present invention is a support which has heightened reflecting properties to make clearer a dye image formed in a silver halide emulsion layer. Such a reflective support includes a support having coated thereon a hydrophobic resin having dispersed therein a light reflecting substance, e.g., titanium oxide, zinc oxide, calcium carbonate, calcium sulfate, etc., and a support made of such a light reflecting substance-containing hydrophobic resin per se. Examples of the reflective support are baryta paper, polyethylene-coated paper, polypropylene-based synthetic paper, and transparent supports having a reflective layer or containing a reflective substance, such as a glass sheet, polyester films, e.g., polyethylene terephthalate, cellulose triacetate, cellulose nitrate, etc., polyamide films, polycarbonate films, polystyrene films, and the like. The support to be used can be selected appropriately from among them according to the end use. Photo-setting resins may also be used as support materials.

The processing steps, i.e., image formation process, according to the present invention will be described below.

According to the present invention, the color development processing is completed within a short processing time of 2 minutes and a half, and preferably in a processing time of from 60 to 120 seconds. The processing time herein referred to means a time of from the contact of a photosensitive material with a color developing solution to the contact with a subsequent bath, and covers, therefore, the time for transfer between baths.

The color developing solution to be used preferably comprises an alkaline aqueous solution containing an aromatic primary amine color developing agent as a main component. The color developing agent includes p-phenylenediamine compounds to advantage, which typically include 3-methyl-4-amino-N,N-diethylaniline, 3-methy-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides, phosphates, p-toluenesulfonates, tetraphenylborates or p-(t-octyl)-benzenesulfonates thereof, and the like.

Aminophenol derivatives may also be used as a developing agent, such as o- or p-aminophenol, 4-amino-2-methylphenol, 2-amino-3-methylphenol, 2-hydroxy-3-amino-1,4-dimethylbenzene, etc.

In addition, color developing agents described in L. F. A. Mason, *Photographic Processing Chemistry*, 226–229, Focal Press (1966), U.S. Pat. Nos. 2,193,015 and 2,592,364, and Japanese patent application (OPI) No. 64933/73 can also be employed. If necessary, these color developing agents may be used in combination of two or more thereof.

The processing temperature for color development preferably ranges from 30° to 50° C. and more preferably ranges from 33° C. to 45° C. From the standpoint of solution stability, etc., the color developing solution preferably has a pH of 12 or less, and more preferably 11.0 or less.

The color developing solution to be used in the invention can contain various development accelerators other than the substantial amount of benzyl alcohol. Usable development accelerators include various pyrimidium compounds, other cationic compounds, cationic dyes (e.g., phenosafranine), and neutral salts (e.g., thallium nitrate, potassium nitrate, etc.) as described, e.g., in U.S. Pat. Nos. 2,648,604 and 3,171,247 and Japanese patent publication No. 9503/69; nonionic compounds, such as polyethylene glycol and derivatives thereof, polythioethers, etc., as described, e.g., in U.S. Pat. Nos. 2,533,990, 2,531,832, 2,950,970, and 2,577,127; thioether compounds as described in U.S. Pat. No. 3,201,242; and compounds described in Japanese patent application (OPI) Nos. 156934/83 and 220344/85.

In carrying out the development in a short time as in the present invention, not only a means for acceleration of development but also a means for prevention of developer fog would be important subjects to consider. Antifoggants which are preferably applicable to the present invention include alkali metal halides, e.g., potassium bromide, sodium bromide, potassium iodide, etc.; and organic antifoggants, such as nitrogen-containing heterocyclic compounds (e.g., benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.), mercapto-substituted heterocyclic compounds (e.g., 1-phenyl-5-mercaptotetrazole, 2-mercaptobenzimidazole, 2-mercaptobenzothiazole, etc.), and mercapto-substituted aromatic compounds (e.g., thiosalicylic acid, etc.). Preferred of these are halides. It does not matter if these antifoggants are eluted from color photosensitive materials during processing and accumulated in the color developing solution.

The color developing solution to be used in the invention can further contain various additives: pH buffering agents, e.g., alkali metal carbonates, borates, or phosphates, etc.; preservatives, e.g., hydroxylamine, triethanolamine, compounds described in West German patent application (OLS) No. 2622950, sulfites, bisulfites, etc.; organic solvents, e.g., diethylene glycol, etc.; dye-forming couplers; competing couplers; nucleating agents, e.g., sodium boron hydride, etc.; auxiliary developing agents, e.g., 1-phenyl-3-pyrazolidone, etc.; thickening agents; chelating agents, such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in Japanese patent application (OPI) No. 195845/83), 1-hydroxyethylidene-1,1'-diphosphonic acid, the organic phosphonic acids described in *Research Disclosure,* No. 18170 (May, 1979), aminophosphonic acids (e.g., aminotris(methylenephosphonic acid), ethylenediamine-N,N,N',N'-tetramethylenephosphonic acid, etc.), and phosphonocarboxylic acids (e.g., those described in Japanese patent application (OPI) Nos. 102726/77, 42730/78, 121127/79, 4024/80, 4025/80, 126241/80, 65955/80, and 65956/80, and *Research Disclosure,* No. 18170 (May, 1979); and the like.

If desired, the color development bath may be divided into two or more, and the first or the last bath is replenished with a color developer replenisher to thereby make reductions in developing time and amount of the replenisher.

After color development, silver halide color photosensitive materials are usually subjected to bleaching. Bleaching may be carried out simultaneously with fixing (bleach-fixing), or these two steps may be effected separately. Bleaching agents to be used include compounds of polyvalent metals, e.g., iron (III), cobalt (III), chromium (VI), copper (II), etc., peracids, quinones, nitroso compounds, etc. Examples of the bleaching agents are ferricyanides; bichromates; organic complex salts of iron (III) or cobalt (III), such as those formed with aminopolycarboxylic acids (e.g., ethylenediaminetetraacetic acid, diethylenetriaminepentaacetic acid, nitrilotriacetic acid, 1,3-diamino-2-propanoltetraacetic acid, etc.), or organic acids (e.g., citric acid, tartaric acid, malic acid, etc.); persulfates, manganates; nitrosophenol; etc. Particularly preferred among them are potassium ferricyanide, sodium (ethylenediaminetetraacetato)iron (III), ammonium (ethylenediaminetetraacetato)iron (III), ammonium (triethylenetetraminepentaacetato)iron (III), and persulfates. (Ethylenediaminetetraacetato)iron (III) complex salts are useful in both an independent bleaching bath and a bleach-fixing monobath.

The bleaching bath or bleach-fixing bath may contain various accelerators, if desired. The accelerators to be used include a bromine ion, an iodine ion, as well as thiourea compounds as described in U.S. Pat. No. 3,706,561, Japanese patent publication Nos. 8506/70 and 26586/84, and Japanese patent application (OPI) Nos. 32735/78, 36233/78, and 37016/78; thiol compounds as described in Japanese patent application (OPI) Nos. 124424/78, 95631/78, 57831/78, 32736/78, 65732/78, and 52534/79, and U.S. Pat. No. 3,893,858; heterocyclic compounds as described in Japanese patent application (OPI) Nos. 59644/74, 140129/75, 28426/78, 141623/78, 104232/78, and 35727/79; thioether compounds as described in Japanese patent application (OPI) No. 84440/83; thiocarbamoyl compounds as described in Japanese patent application (OPI) No. 42349/84; and the like.

Fixing agents to be used include thiosulfates, thiocyanates, thioether compounds, thioureas, a large amount of iodides, etc., with thiosulfates being widely employed. Preservatives for the bleach-fixing bath or fixing bath preferably include sulfites, bisulfites, and carbonyl-bisulfite addition products.

Bleach-fixing or fixing is usually followed by washing with water. For the purpose of preventing sedimentation or saving water, a washing bath can contain various known compounds according to necessity. Such compounds include water softeners for preventing sedimentation, e.g., inorganic phosphoric acids, aminopolycarboxylic acids, organic phosphoric acids, etc.; bactericides or anti-molds for preventing growth of various bacteria, algae or fungi; hardeners, e.g., magnesium salts, aluminum salts, etc.; surface active agents for reducing a drying load or preventing unevenness, and the like. The compounds described in L. E. West, *Photo. Sci. and Eng.,* Vol. 9, No. 6 (1965) may also be added. In particular, addition of chelating agents and anti-molds is effective. Water saving can be achieved by carrying out washing in a multistage (e.g., 2 to 5 stages) countercurrent system.

The washing step may be followed by or replaced with a multistage countercurrent stabilization step as described in Japanese patent application (OPI) No. 8543/82. The stabilizing step requires from 2 to 9 vessels arranged in a countercurrent system. The stabilizing bath contains various additives for image stabilization, such as buffering agents for film pH-adjustment (e.g., borates, metaborates, borax, phosphates, carbonates, potassium hydroxide, sodium hydroxide, aqueous ammonia, monocarboxylic acids, dicarboxylic acids, polycarboxylic acids, etc.), and formalin. If desired, the stabilizing bath can further contain water softeners (e.g., inorganic or organic phosphoric acids, aminopolycarboxylic acids, aminopolyphosphonic acids, phosphonocarboxylic acids, etc.), bactericides (e.g., Proxel®, isothiazolone, 4-thiazolylbenzimidazole, halogenated phenolbenzotriazoles, etc.), surface active agents, fluorescent brightening agents, hardeners, etc.

The stabilizing bath may furthermore contain, as film pH adjustors after processing, various ammonium salts, e.g., ammonium chloride, ammonium nitrate, ammonium sulfate, ammonium phosphate, ammonium sulfite, ammonium thiosulfate, etc.

It is preferred that a color coupler contained in a photosensitive material has a ballast group or is a polymeric compound, and consequently it is a nondiffusible coupler. A two-equivalent color coupler having an active site for coupling substituted by a split-off group can have a larger reduction in coating weight of silver than a four-equivalent color coupler having an active site for coupling bonded with a hydrogen atom. Such a coupler capable of forming an appropriately diffusible dye, a non-color forming coupler, a DIR coupler capable of releasing a development inhibitor upon coupling reaction, and a coupler capable of releasing a development accelerator upon coupling reaction can also be used.

Typical examples of yellow couplers which may be used in the present invention are oil protect-type, acylacetamide-based couplers. Specific examples thereof are described, for example, in U.S. Pat. Nos. 2,407,210, 2,875,057, and 3,265,506. Two-equivalent yellow couplers are particularly preferably used in the present invention; and typical examples thereof are oxygen atom-releasing type yellow couplers as described in U.S. Pat. Nos. 3,408,194, 3,447,928, 3,933,501, and 4,022,620; and nitriogen atom-releasing type yellow couplers as described in Japanese patent publication No. 10739/83, U.S. Pat. Nos. 4,401,752 and 4,326,024, *Research Disclosure,* No. 18053 (April, 1979), British Pat. No. 1,425,020, and German patent application (OLS) Nos. 2,219,917, 2,261,361, 2,329,587, and 2,433,812.

α-Pivaloylacetanilide-based couplers are good in fastness, especially to light, of the formed dyes; and, on the othe hand, α-benzoylacetanilide-based couplers are high in color density of the formed dyes.

Magenta couplers which may be used in combination in the present invention are oil protect-type, indazolone-based or cyanoacetyl-based couplers, preferably 5-pyrazolone-based or pyrazoloazole-based couplers. Among the 5-pyrazolone-based couplers, those whose 3-position is substituted by an arylamino group or an acylamino group are preferred because of hue and color density of the formed dyes. Typical examples of these couplers are described in U.S. Pat. Nos. 2,311,082, 2,343,703, 2,600,788, 2,908,573, 3,062,653, 3,152,896, and 3,936,015. Regarding the split-off group of the two-equivalent 5-pyrazolone-based couplers, nitrogen atom-releasing groups as described in U.S. Pat. No. 4,310,619 and arylthio groups as described in U.S. Pat. No. 4,351,897 are especially preferred. In addition, ballast group-containing 5-pyrazolone-based couplers as described in European Pat. No. 73,637 are preferred because they provide a high color density.

Pyrazoloazole-based couplers which may be used in the present invention include pyrazolobenzimidazoles as described in U.S. Pat. No. 3,369,879, preferably pyrazolo[5,1-c][1,2,4]triazoles as described in U.S. Pat. No. 3,725,067; pyrazolotetrazoles as described in *Research Disclosure,* No. 24220 (June, 1984); and pyrazolopyrazoles as described in *Research Disclosure,* No. 24230 (June, 1984). In particular, imidazo[1,2-b]pyrazoles as described in European Pat. No. 119,741 are preferred because the yellow side-absorption of the formed dyes is small and the light-fastness thereof is high and, especially, pyrazolo[1,5-b][1,2,4]triazole as described in European Pat. No. 119,860 is particularly preferred.

As cyan couplers which can be used in the present invention, oil protect-type naphthol-based and phenol-based couplers can be exemplified. Typical examples thereof include naphthol-based couplers as described in U.S. Pat. No. 2,474,293 and preferably oxygen atom-releasing type two-equivalent naphthol-based couplers as described in U.S. Pat. Nos. 4,052,212, 4,146,396, 2,448,233, 4,296,200, etc. Specific examples of phenol-based couplers are described in U.S. Pat. Nos. 2,369,929, 2,801,171, 2,772,162, 2,895,826, etc.

Cyan couplers capable for forming cyan dyes fast to humidity and temperature are preferably used in the present invention. Typical examples thereof include phenol-based cyan couplers having an alkyl group more than a methyl group at the meta-position of the phenol nucleus as described in U.S. Pat. No. 3,772,002, 2,5-diacylaminosubstituted phenol-based couplers as described in U.S. Pat. Nos. 2,772,162, 3,758,308, 4,126,396, 4,334,011, and 4,327,173, West German patent application (OLS) No. 3,329,729, European Pat. No. 121,365, etc., phenol-based couplers having a phenylureido group at the 2-position thereof and an acylamino group at the 5-position thereof as described in U.S. Pat. Nos. 3,446,622, 4,333,999 4,451,559, 4,427,767, etc.

Further, couplers capable of forming appropriately diffusible dyes can be used together in order to improve graininess. Specific examples of such types of magenta couplers are described in U.S. Pat. No. 4,366,237, British Pat. No. 2,125,570, etc. and those of yellow, magenta, and cyan couplers are described in European Pat. No. 96,570, West German patent application (OLS) Nos. 3,234,533, etc.

Dye-forming couplers and the above-described special couplers may form polymers including dimers or more. Typical examples of polymerized dye-forming couplers are described in U.S. Pat. Nos. 3,451,820, 4,080,211, etc. Specific examples of polymerized magenta couplers are described in British Pat. No. 2,102,173, U.S. Pat. Nos. 4,367,282, etc.

To satisfy characteristics required for a particular photographic material, two types or more of couplers used in the invention can be combined in the same photosensitive layer or the same coupler used in the invention can be introduced into two or more different photosensitive layers.

A standard amount of the color coupler used is within a range of from 0.001 to 1 mol per mol of the photosensitive silver halide, and a preferred used amount based on the same basis as the above is from 0.01 to 0.5 mol for the yellow coupler, from 0.003 to 0.3 mol for the magenta coupler, from 0.002 to 0.3 mol for the cyan coupler, respectively.

The photosensitive material produced by the invention may contain hydroquinone derivatives, aminophenol derivatives, amines, gallic acid derivatives, catechol derivatives, ascorbic acid derivatives, non-color forming couplers, sulfonamidophenol derivatives, or the like as a color fog-preventing agent or a color mixing-preventing agent.

A well-known discoloration preventing agent can be used in the photosensitive material of the invention. As representative examples of organic discoloration preventing agents, there may be mentioned hydroquinones, 6-hydroxychromans, 5-hydroxycoumaranes, spirochromans, p-alkoxyphenols, hindered phenols represented by bisphenols, gallic acid derivatives, methylenedioxybenzenes, aminophenols, hindered amines, and ether or ester derivatives obtained by acylation or alkylation of the phenolic hydroxyl group of these compounds. Further, metal complexes represented by (bis-salicylaldoximato)nickel complexes and (bis-N,N-dialkyldithiocarbamato)nickel complexes can also be used.

As described in U.S. Pat. No. 4,268,593, a compound having the structure of both a hindered amine and a hindered phenol in the molecule thereof provides good results to prevent a yellow dye image from deterioration caused by heat, humidity, and light. Further, spiroindanes as described in Japanese patent application (OPI) No. 159644/81 and chromans substituted by a hydroquinone diether or monoether as described in Japanese patent application (OPI) No. 89835/80 provide preferred results to prevent a magenta dye image from deterioration, particularly that caused by light.

To improve preservability, particularly fastness to light, of a cyan image, it is preferred to combine a benzotriazole-based ultraviolet light absorbing agent with a cyan coupler. This ultraviolet light absorbing agent may be co-emulsified with the cyan coupler.

It is satisfactory if a coating weight of the ultraviolet light absorbing agent is an amount sufficient to impart light stability to the cyan dye image, but use of an excessive amount of the agent sometimes results in yellowing in the unexposed part (white part) of the color photographic material, so that the coating weight of the agent is set in a range of, preferably, from $1\times10^{-4}$ to $2\times10^{-3}$ mol/m$^2$, and especially preferably from $5\times10^{-4}$ to $1.5\times10^{-3}$ mol/m$^2$.

In the constitution of a photosensitive layer of usual color paper, an ultraviolet light absorbing agent is contained in any one or both of the both side layers adjacent to a red-sensitive emulsion layer containing a cyan coupler. When an ultraviolet light absorbing agent is added to an interlayer between a green-sensitive layer and a red-sensitive layer, the agent may be co-emulsified with a color mixing-preventing agent. If an ultraviolet light absorbing agent is added to a protective layer, another protective layer may be provided as an outermost layer. In the protective layer, a matting agent having an arbitrary particle size and the like can be contained.

The photosensitive material of the invention may contain a water soluble dye in a hydrophilic colloid layer as a filter dye or with the aim of preventing irradiation, halation, or the like.

A stilbene-, triazine-, oxazole-, or coumarin-based brightening agent may be contained in a photographic emulsion layer or other hydrophilic colloid layer of the photosensitive material of the invention. In this case, a water soluble brightening agent may be used, or a water insoluble brightening agent may be used in the form of a dispersion.

As mentioned above, the invention can be applied to a multilayer, multicolor photographic material having at least two layers of different spectral sensitivity on a support. The multilayer, multicolor photographic material usually has at least one layer of each of a red-sensitive emulsion layer, a green-sensitive emulsion layer, and a blue-sensitive emulsion layer on a support. The order of these layers disposed can be selected appropriately, depending on the intended use. Further, each emulsion layer described above may be composed of two or more emulsion layers of different sensitivity, and also a photosensitive layer may be present between two or more emulsion layers having the same color sensitivity.

It is preferred to dispose appropriately auxiliary layers such as a protective layer, an interlayer, a filter layer, a halation-preventing layer, a back layer, and the like, in addition to the silver halide emulsion layers, on the photosensitive material of the invention.

It is advantageous to use gelatin as a binder or protective colloid usable in an emulsion layer or interlayer of the photosensitive material of the invention, but hydrophilic colloids other than gelatin can also be used.

Examples of these hydrophilic colloids are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, limed gelatin as well as acid-treated gelatin and also enzyme-treated gelatin as described in *Bull. Soc. Phot. Japan,* No. 16, 30 (1966) can be used. Furthermore, hydrolyzed products or enzymedecomposed products of gelatin can be used.

To the photosensitive material of the invention, in addition to the above-mentioned additives, various stabilizers, stain-preventing agents, developing agents or precursors thereof, development accelerators or precursors thereof, lubricating agents, mordants, matting agents, antistatics, plasticizers, and other various additives useful for photosensitive materials may further be added. Representative examples of these additives are described in *Research Disclosure,* RD Nos. 17643 (December, 1978) and 18716 (November, 1979).

Examples of silver halide emulsions usable in the invention include silver bromide, silver chlorobromide, and silver chloride, each containing substantially no silver iodide, and a preferably used silver halide is silver chlorobromide.

By "substantially no silver iodide" is meant the content of silver iodide of 2 mol% or less. Preferably, the silver iodide content is 1 mol% or less and most preferably 0 mol%.

If color development properties are high and fogs are apt to be formed in the invention, it is preferred to reduce the content of silver chloride to 30 mol% or less and more preferably 20 mol% or less.

If a rapid treatment is desired utilizing good color development properties in the invention, an increase of silver chloride content to 80 mol% and more and preferably 90 mol% and more results in good results sometimes.

Silver halide grains to be used may have a homogeneous phase, a heterogeneous phase comprising a core and an outer shell or a multiphase structure having a fusion structure, or a mixture thereof.

The silver halide grains preferably have a mean grain size of from 0.1 to 2 $\mu$m, and more preferably from 0.15 to 1 $\mu$m, the mean grain size being mean diameter of spherical or nearly spherical grains or a mean edge length of cubic grains, averaged based on the projected area. Grain size distribution may be either narrow or broad, but it is preferably to use a so-called monodisperse silver halide emulsion having not greater than 20%, and more preferably not greater than 15%, of a coefficient of variation of grain size (i.e., a quotient of a standard deviation of a size distribution curve divided by a mean grain size). In order to obtain desired gradation, two or more kinds of monodisperse silver halide emulsions (preferably those having a coefficient of variation within the above-recited range) being different in grain size can be mixed and coated as a single emulsion layer or they may be coated separately in two or more layers having substantially the same color sensitivity. Further, two or more kinds of polydisperse silver halide emulsions or a combination of a monodiserse emulsion and a polydisperse emulsion may be mixed or separately coated.

The silver halide grains may have a regular crystal form, e.g., a cube, an octahedron, a dodecahedron, a tetradecahedron, etc., or an irregular (e.g., spherical, tabular, etc.) crystal form, or a composite form thereof. In particular, a tabular grain emulsion containing at least 50%, based on the total projected area, of tabular grains having a ratio of length to thickness of 5 or more, and preferably 8 or more, can be employed. The emulsion may be a mixture of these various silver halide grains. The emulsion may be either of the surface latent image type which forms a latent image predominantly on the surface or of the internal latent image type which forms a latent image predominantly in the interior of grains.

The photographic emulsions to be used in the invention can be prepared by known methods as described e.g., in P. Glafkides, *Chimie et Physique Photographique,* Paul Montel (1967), G. F. Duffin, *Photographic Emulsion Chemistry,* Focal Press (1966), V. L. Zelikman et al, *Making and Coating Photographic Emulsion,* Focal Press (1964), etc. In some detail, the emulsion can be prepared by any of the acid process, the neutral process, the ammonia process, and the like. The reaction between soluble silver salts and soluble halogen salts can be carried out by any of the single jet process, the double jet process, and a combination thereof. A so-called reverse mixing method, in which silver halide grains are formed in the presence of excess silver ions, may also be used. Further, a so-called controled double jet method, in which a pAg of a liquid phase where silver halide grains are formed is maintained constant, can be adopted. According to this method, a silver halide emulsion having a regular crystal form and an almost uniform grain size can be obtained.

In addition, an emulsion prepared by a so-called conversion method which involves a step of converting silver halide grains formed to those having a smaller solubility product by the end of the grain formation step, or an emulsion having undergone such conversion after the end of the grain formation step can also be employed.

In the step of silver halide grain formation or physical ripening, a cadmium salt, a zinc salt, a lead salt, a thallium salt, a iridium salt or a complex salt thereof, a rhodium salt or a complex salt thereof, an iron salt or a complex salt thereof, etc., may be present in the system.

The silver halide emulsion thus prepared is usually subjected to physical ripening, desalting, and chemical ripening prior to coating.

In the precipitation, physical ripening, or chemical ripening, known silver halide solvents can be used. Examples of usable silver halide solvents are ammonia, potassium thiocyanate, and thioethers and thione compounds as described in U.S. Pat. No. 3,271,157, and Japanese patent application (OPI) Nos. 12360/76, 82408/78, 144316/78, 100717/79, and 155828/79. Removal of soluble silver salts from emulsions after physical ripening can be carried out by noodle washing, flocculation-sedimentation, or ultrafiltration.

Chemical sensitization of the silver halide emulsion can be performed by sulfur sensitization using active gelatin or a compound containing sulfur capable of reacting with silver (e.g., thiosulfates, thioreas, mercapto compounds, rhodanines, etc.); reduction sensitization using a reducing substance (e.g., stannous salts, amines, hydrazine derivatives, formamidinesulfinic acid, silane compounds, etc.); noble metal sensitization using a metal compound (e.g., complex salts of gold as well as metals of Group III of the periodic table, e.g., Pt, Ir, Pd, Rh, Fe, etc.); or a combination thereof. Sulfur sensitization is preferred.

The blue-sensitive, green-sensitive, or red-sensitive emulsion according to the present invention is obtained by spectrally sensitizing the respective layers with methine dyes or others so as to have the respective color sensitivity. Sensitizing dyes to be used include cyanine dyes, merocyanine dyes, complex cyanine dyes, complex merocyanine dyes, holopolar cyanine dyes, hemicyanine dyes, styryl dyes, and hemioxonol dyes. Particularly preferred are cyanine dyes, merocyanine dyes, and complex merocyanine dyes. Any of nuclei commonly utilized in cyanine dyes as a basic heterocyclic nucleus are applicable to these sensitizing dyes. Specific examples of applicable nuclei include a pyrroline nucleus, an oxazoline nucleus, a thiazoline nucleus, a pyrrole nucleus, an oxazole nucleus, a thiazole nucleus, a selenazole nucleus, an imidazole nuclues, a tetrazole nucleus, a pyridine nucleus, etc.; the above-described nucleus to which an alicyclic hydrocarbon ring is fused; and the above-described nucleus to which an aromatic hydrocarbon ring is fused, e.g., an indolenine nucleus, a benzindolenine nucleus, an indole nucleus, a benzoxazole nucleus, a naphthoxazole nuclues, a benzothiazole nucleus, a naphthothiazole nucleus, a benzoselenazole nucleus, a benzimidazole nucleus, a quinoline nucleus, etc. These nuclei may have a substituent on their carbon atoms.

To the merocyanine dyes or complex merocyanine dyes is applicable a 5- to 6-membered heterocyclic nucleus having a ketomethylene structure, e.g., a pyrazoline-5-one nucleus, a thiohydantoin, a 2-thiooxazolidin-2,4-dione nucleus, a thiazolidin-2,4-dione nucleus, a rhodanine nucleus, a thiobarbituric acid nucleus, etc.

These sensitizing dyes may be used either individually or in combinations thereof. Combinations of sensitizing dyes are frequently used for the purpose of supersensitization. Typical examples of such combinations of sensitizing dyes are described in U.S. Pat. Nos. 2,688,545, 2,977,229, 3,397,060, 3,522,052, 3,527,641, 3,617,293, 3,628,964, 3,666,480, 3,672,898, 3,697,428, 3,703,377, 3,769,301, 3,814,609, 3,837,862, and 4,026,707, British Pat. Nos. 1,344,281 and 1,507,803, Japanese patent publication Nos. 4936/68 and 12375/78, and Japanese patent application (OPI) Nos. 110618/77 and 109925/77.

The silver halide emulsions may further contain, in combination with the sensitizing dyes, dyes which do not per se have spectral sensitizing activity, or substance which do not substantially absorb visible light, but which do not show supersensitizing effects.

The present invention will now be illustrated in greater detail with reference to the following examples, but it should be understood that the present invention is not limited thereto. In these examples, all the percents are given by weight unless otherwise indicated.

Some of compounds used in the examples will be shown hereinafter.

The following compound was used as a gelatin hardener.

Sodium 1-oxy-3,5-dichloro-s-triazine

The following compound were used as a spectral sensitizing agent for each emulsion.

Blue-sensitive emulsion layer:

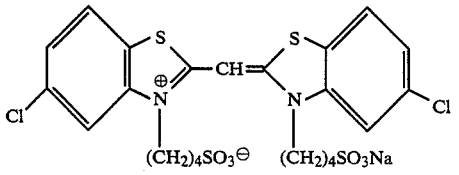

Green-sensitive emulsion layer:

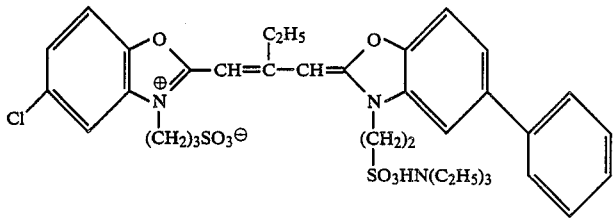
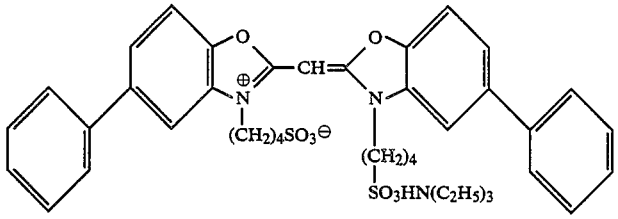
Red-sensitive enulsion layer:
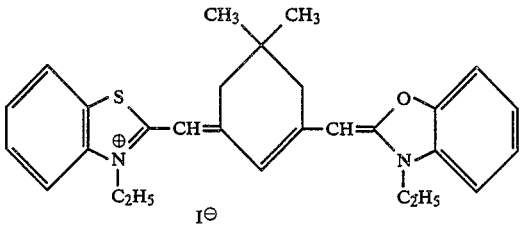
The following dyes were used an an irradiation-preventing dye for each emulsion layer.
Green-sensitive emulsion layer:
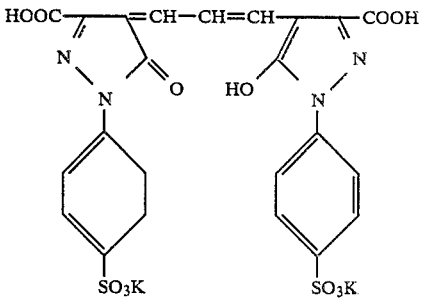
Red-sensitive emulsion layer:
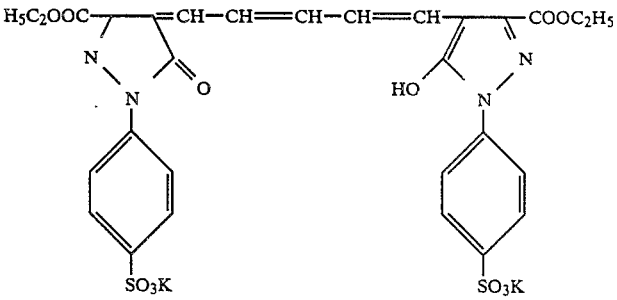
(a) Yellow coupler:
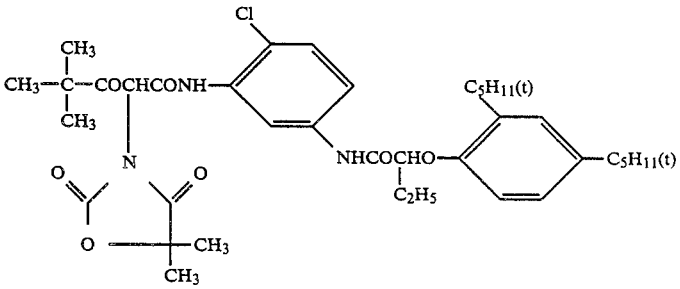
(b) Color image stabilizer:

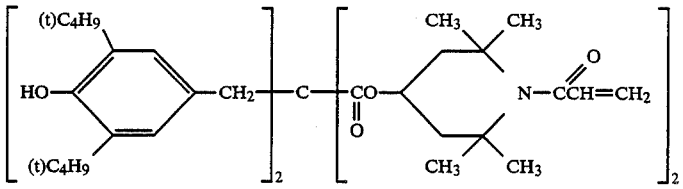
(c) Solvent:
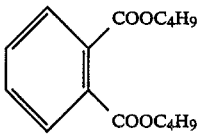
(d) Color mixing-preventing agent:
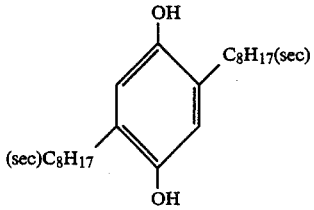
(e) Magenta coupler:
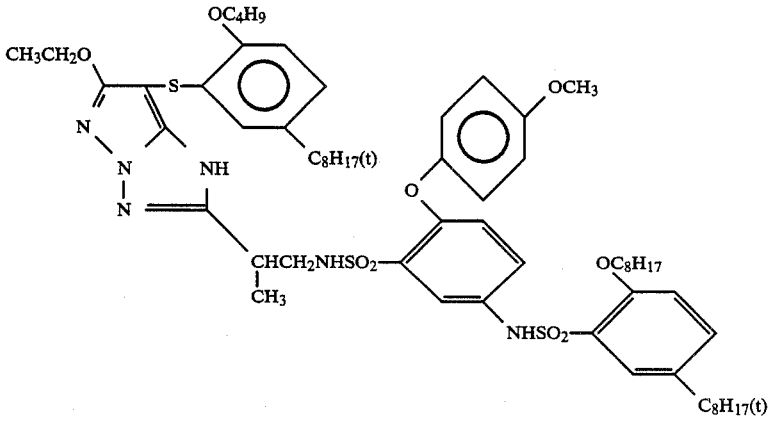
(f) Color image stabilizer:
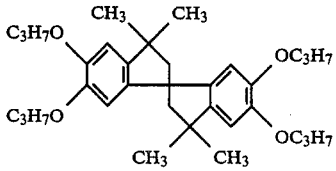
(g) Solvent:
A mixture of
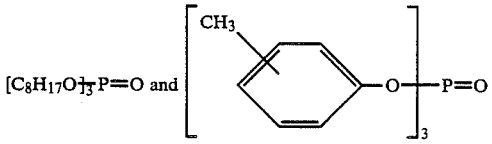
at a weight ratio of 2/1.
(h) Ultraviolet light absorbing agent:
A mixture of
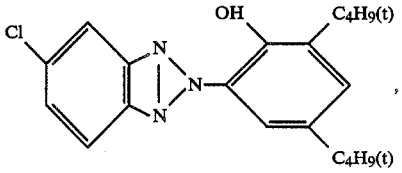
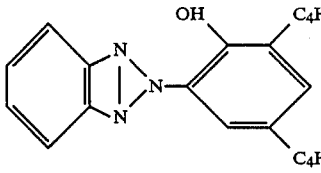
, and
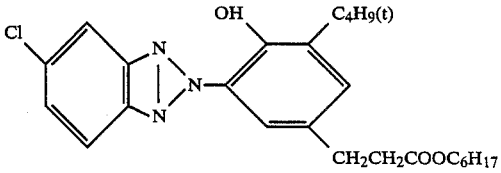
at a molar ratio of 1/5/3.
(i) Color mixing-preventing agent:

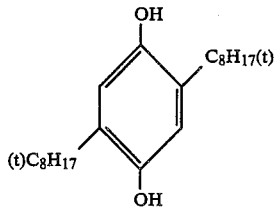

(j) Solvent:

$(iso—C_9H_{19}O)_3P=O$ (k) Cyan coupler:

A mixture of

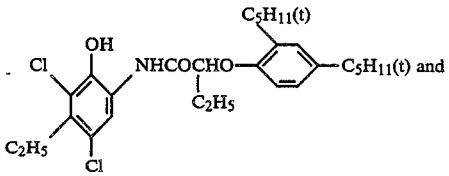

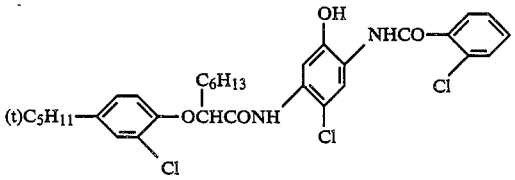

at a molar ratio of 1/1.

(l) Color image stabilizer

A mixture of

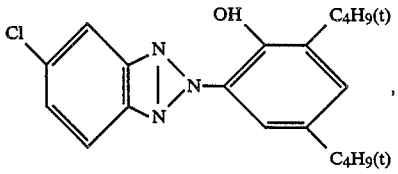

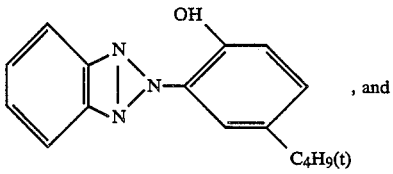

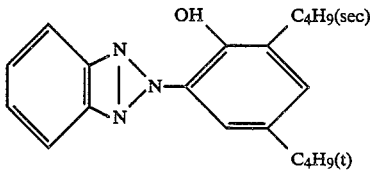

at a molar ratio of 1/3/3.

(m) Solvent:

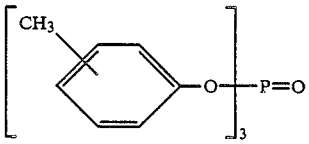

EXAMPLE 1

The following layers were applied to a paper support laminated with polyethylene on both surfaces thereof in an order of enumeration of them to prepare a Sample (1) (for comparison).

Sample (1) (for comparison)

Layer (1): A layer containing silver chlorobromide containing 20 mol% of silver bromide (coating amount as silver 1.41 g/m$^2$), gelatin (0.99 g/m$^2$), cyan coupler (k) (0.32 g/m$^2$), solvent (c) (0.21 g/m$^2$), and Compound (35) (0.020 g/m$^2$).

Layer (2): A layer containing 1.0g/m$^2$ of gelatin and 0.04 g/m$^2$ of the above-mentioned gelatin hardener.

Sample (2) for comparison, Samples (3) to (20) of the invention, and Samples (21) and (22) for comparison were prepared as follows.

Sample (2) (for comparison)

It was prepared by the same method as in Sample (1) except that Compound (36) was used instead of Compound (35) used in layer (1) of Sample (1).

Sample (3) (invention)

It was prepared by the same method as in Sample (1) except that 0.020 g/m$^2$ of Compound (35) was further added to layer (1) of Sample (1) (that is, the total amount of Compound (35) used in layer (1) was 0.040 g/m$^2$).

Sample (4) (invention)

It was prepared by the same method as in Sample (2) except that 0.045 g/m$^2$ of Compound (36) was further added to layer (1) of Sample (2).

Sample (5) (invention)

It was prepared by the same method as in Sample (1) except that 0.040 g/m$^2$ of Compound (1) was further added to layer (1) of Sample (1).

Sample (6) (invention)

It was prepared by the same method as in Sample (2) except that 0.060 g/m$^2$ of Compound (2) was further added to layer (1) of Sample (2).

Sample (7) (invention)

It was prepared by the same method as in Sample (1) except that 0.060 g/m$^2$ of Compound (11) was further added to layer (1) of Sample (1).

Sample (8) (invention)

It was prepared by the same method as in Sample (1) except that 0.080 g/m$^2$ of Compound (34) was further added to layer (1) of Sample (1).

Sample (9) (invention)

It was prepared by the same method as in Sample (1) except that 0.070 g/m$^2$ of Compound (43) was further added to layer (1) of Sample (1).

Sample (10) (invention)

It was prepared by the same method as in Sample (1) except that 0.070 g/m$^2$ of Compound (45) was further added to layer (1) of Sample (1).

Sample (11) (invention)

It was prepared by the same method as in Sample (2) except that 0.080 g/m$^2$ of Compound (52) was further added to layer (1) of Sample (2).

Sample (12) (invention)

It was prepared by the same method as in Sample (1) except that 0.070 g/m$^2$ of Compound (55) was further added to layer (1) of Sample (1).

Sample (13) (invention)

It was prepared by the same method as in Sample (1) except that 0.060 g/m$^2$ of Compound (68) was further added to layer (1) of Sample (1).

Sample (14) (invention)

It was prepared by the same method as in Sample (1) except that 0.080 g/m$^2$ of Compound (74) was further added to layer (1) of Sample (1).

Sample (15) (invention)

It was prepared by the same method as in Sample (1) except that 0.0100 g/m$^2$ of Compound (82) was further added to layer (1) of Sample (1).

Sample (16) (invention)

It was prepared by the same method as in Sample (1) except that 0.020 g/m$^2$ of Compound (86) was further added to layer (1) of Sample (1).

Sample (17) (invention)

It was prepared by the same method as in Sample (2) except that 0.110 g/m$^2$ of Compound (88) was further added to layer (1) of Sample (2).

Sample (18) (invention)

It was prepared by the same method as in Sample (2) except that 0.050 g/m$^2$ of Compound (91) was further added to layer (1) of Sample (2).

Sample (19) (invention)

It was prepared by the same method as in Sample (4) except that 0.210 g/m$^2$ of Compound (101) was further added to layer (1) of Sample (4).

Sample (20) (invention)

It was prepared by the same method as in Sample (1) except that 0.040 g/m$^2$ of Compound (112) was further added to layer (1) of Sample (1).

Sample (21) (for comparison)

It was prepared by the same method as in Sample (1) except that 0.980 g/m$^2$ of Compound (35) was further added to layer (1) of Sample (1) (that is, the total amount of Compound (35) used in layer (1) was 1.000 g/m$^2$).

Sample (22) (invention)

It was prepared by the same method as in Sample (1) except that 0.980 g/m$^2$ of Compound (11) was further added to layer (1) of Sample (1) (that is, the total amount of Compound (11) and Compound (35) used in layer (1) was 1.000 g/m$^2$).

Gradation exposure for sensitometry was applied to the above-mentioned Samples (1) to (22) with a sensitometer (an FH type having a color temperature of light source of 3.200° K., a product of Fuji Photo Film Co., Ltd.).

Next, experiments of processing A and processing B using color developing soltion (A) (containing benzyl alcohol) and color developing solution (B) (containing no benzyl alcohol) as set forth below, respectively, were carried out for each of the above-mentioned samples. Process steps other than the color development were the same in all cases.

The processing consisted of each process of color development, bleach-fixing, and washing with water. After the processing was applied to the sample, the resulting samples were evaluated for photographic properties.

The contents of each of the process steps used and the formulations of processing solutions used are described hereinafter.

| Process Step | Temperature | Time |
|---|---|---|
| Color development | 35° C. | 45 sec |
| Bleach-fixing | 35° C. | 1 min |
| Washing | 28 to 35° C. | 2 min |

Formulation of Developing Solution

Color developing solution (A) (containing benzyl alcohol):

| | |
|---|---|
| Trisodium nitrilotriacetate | 2.0 g |
| Benzyl alcohol | 15 ml |
| Diethylene glycol | 10 ml |
| $Na_2SO_3$ | 2.0 g |
| KBr | 0.15 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| Adenine | 0.03 g |
| Fluorescent brightening agent (stilbene-based) | 1.0 g |
| $Na_2CO_3$ (monohydrate) | 20.0 g |
| Water to make | 1,000 ml (pH 10.0) |

Color developing solution (B) (containing no benzyl alcohol):

| | |
|---|---|
| Trisodium nitrilotriacetate | 2.0 g |
| $Na_2SO_3$ | 1.0 g |
| KBr | 0.4 g |
| Hydroxylamine sulfate | 3.0 g |
| 4-Amino-3-methyl-N—ethyl-N—[β-(methanesulfonamido)ethyl]-p-phenylenediamine sulfate | 4.5 g |
| Adenine | 0.03 g |
| Fluorescent brightening agent (stilbene-based) | 1.0 g |
| $Na_2CO_3$ (monohydrate) | 40 g |
| Water to make | 1,000 ml |

-continued (pH 6.9)

After the above-mentioned process steps were applied to each sample, it was evaluated for color development properties by the following method. The exposure necessary to provide a color density of 2 for a sample when processed by processing A was determined in advance, and the color density (D) of a sample when processed by processing B after the same exposure as the above had been applied to it was determined. Herein, a scale, namely, the S value of color development properties was defined as follows, and the S value determined for each sample is shown in Table 1.

$$S \text{ value} = \frac{D}{2.0}$$

TABLE 1

| Sample | Surface active agent used in invention: Compound Type | Compound Amount ($g/m^2$) | Compound Type | Compound Amount ($g/m^2$) | Total amount ($g/m^2$) | Weight ratio to coupler | S Value |
|---|---|---|---|---|---|---|---|
| (1)* | (35) | 0.020 | — | — | 0.020 | 0.063 | 0.69 |
| (2)* | (36) | 0.020 | — | — | 0.020 | 0.063 | 0.68 |
| (3) | (35) | 0.040 | — | — | 0.040 | 0.125 | 0.82 |
| (4) | (36) | 0.065 | — | — | 0.065 | 0.203 | 0.83 |
| (5) | (35) | 0.020 | (1) | 0.040 | 0.060 | 0.188 | 0.93 |
| (6) | (36) | 0.020 | (2) | 0.060 | 0.080 | 0.250 | 0.95 |
| (7) | (35) | 0.020 | (11) | 0.060 | 0.080 | 0.250 | 0.94 |
| (8) | (35) | 0.020 | (34) | 0.080 | 0.100 | 0.313 | 0.91 |
| (9) | (35) | 0.020 | (43) | 0.070 | 0.090 | 0.281 | 0.94 |
| (10) | (35) | 0.020 | (45) | 0.070 | 0.090 | 0.281 | 0.96 |
| (11) | (36) | 0.020 | (52) | 0.080 | 0.100 | 0.313 | 0.96 |
| (12) | (35) | 0.020 | (55) | 0.070 | 0.090 | 0.281 | 0.97 |
| (13) | (35) | 0.020 | (68) | 0.060 | 0.080 | 0.250 | 0.92 |
| (14) | (35) | 0.020 | (74) | 0.080 | 0.100 | 0.313 | 0.94 |
| (15) | (35) | 0.020 | (82) | 0.100 | 0.120 | 0.375 | 0.97 |
| (16) | (35) | 0.020 | (86) | 0.020 | 0.040 | 0.125 | 0.91 |
| (17) | (36) | 0.020 | (88) | 0.110 | 0.130 | 0.406 | 0.96 |
| (18) | (36) | 0.020 | (91) | 0.050 | 0.070 | 0.219 | 0.93 |
| (19) | (36) | 0.065 | (101) | 0.210 | 0.275 | 0.859 | 0.92 |
| (20) | (35) | 0.020 | (112) | 0.040 | 0.060 | 0.188 | 0.96 |
| (21)* | (35) | 1.000 | — | — | 1.000 | 3.125 | 0.69 |
| (22)* | (35) | 0.020 | (11) | 0.980 | 1.000 | 3.125 | 0.67 |

(Note) *comparative sample

As is clearly shown in Table 1, even when the samples of the invention, that is, Samples (3) to (20), are processed with color developing solution (B) containing no benzyl alcohol, they show color development properties equal to or approximating those thereof when processed with color developing solution (A) containing benzyl alcohol, different from Samples (1) and (2) for comparison.

In Table 1, it is also clearly shown that Samples (21) and (22) for comparison using the surface active agent in amount exceeding the range of the agent used in the invention have color development properties equal to or less than those of Samples (1) and (2) for comparison. Further, with Samples (21) and (22), adverse influence were observed in that physical properties of the film were bad, the surface of the film was sticky, and the dye image was unclear.

EXAMPLE 2

Photosensitive Material (A) for comparison was prepared. Its contents are shown in Table 2. In Table 2, however, a gelatin hardener and a surface active agent were omitted. Further, Compound (35) was contained in the material in a total amount of 0.122 $g/m^2$. This amount was 0.080 times the total weight of all couplers contained in the material.

TABLE 2

| Layer | Main Composition | Amount used |
|---|---|---|
| 7th layer (Protective layer) | Gelatin | 1.33 $g/m^2$ |
| | Acryl-modified copolymer of polyvinyl alcohol (modification degree: 17%) | 1.17 $g/m^2$ |
| 6th layer (Ultraviolet light absorbing layer) | Gelatin | 0.61 $g/m^2$ |
| | Ultraviolet light absorbing agent (h) | 0.21 $g/m^2$ |
| | Solvent (j) | 0.09 $ml/m^2$ |
| 5th layer (Red-sensitive layer) | Silver chlorobromide emulsion (silver bromide: 20 mol % as Ag) | 0.30 $g/m^2$ |
| | Gelatin | 0.99 $g/m^2$ |
| | Cyan coupler (k) | 0.41 $g/m^2$ |
| | Color image stabilizer (1) | 0.19 $g/m^2$ |
| | Solvent (m) | 0.25 $ml/m^2$ |
| 4th layer (Ultraviolet light absorbing layer | Gelatin | 1.63 $g/m^2$ |
| | Ultraviolet light absorbing agent (h) | 0.62 $g/m^2$ |
| | Color mixing-preventing agent (i) | 0.06 $g/m^2$ |
| | Solvent (j) | 0.27 $ml/m^2$ |
| 3rd layer (Green-sensitive layer) | Silver chlorobromide emulsion (silver bromide: 20 mol % as Ag) | 0.21 $g/m^2$ |
| | Gelatin | 1.92 $g/m^2$ |
| | Magenta coupler (e) | 0.33 $g/m^2$ |
| | Color image stabilizer (f) | 0.21 $g/m^2$ |
| | Solvent (g) | 0.70 $ml/m^2$ |
| 2nd layer (Color mixing-preventing layer) | Gelatin | 0.99 $g/m^2$ |
| | Color mixing-preventing agent (d) | 0.08 $g/m^2$ |
| 1st layer (Blue-sensitive layer) | Silver chlorobromide emulsion (silver bromide: 6 mol % as Ag) | 0.36 $g/m^2$ |
| | Gelatin | 1.86 $g/m^2$ |
| | Yellow coupler (a) | 0.78 $g/m^2$ |
| | Color image stabilizer (b) | 0.12 $g/m^2$ |
| | Solvent (c) | 0.41 $ml/m^2$ |
| Support | Paper laminated with polyethylene (White pigment ($TiO_2$) and blue dye (ultramarine blue) are contained in the polyethylene in the first layer side.) | |

Further, Photosensitive Materials (B) to (Q) for comparison and of the invention were prepared as the following.

Photosensitive Material (B) (for comparison)

A photosensitive material having the same formulation as that of Photosensitive Material (A) except that Compound (36) was used instead of Compound (35) used in Photosensitive Material (A).

Photosensitive Material (C) (invention)

A photosensitive material having the same formulation as that of Photosensitive Material (A) except that 0.017 $g/m^2$, 0.017 $g/m^2$, and 0.019 $g/m^2$ of Compound (35) were further added to the first layer, third layer, and fifth layer of Photosensitive Material (A), respectively.

Photosensitive Material (D) (invention)

A photosensitive material having the same formulation as that of Photosensitive Material (A) except that 0.561 $g/m^2$, 0.563 $g/m^2$, and 0.564 $g/m^2$ of Compound (35) were further added to the first layer, third layer, and fifth layer of Photosensitive Material (A), respectively.

Photosensitive Material (E) (invention)

A photosensitive material having the same formulation as that of Photosensitive Material (B) except that 0.054 g/m$^2$, 0.061 g/m$^2$, and 0.047 g/m$^2$ of Compound (2) were further added to the first layer, third layer, and fifth layer of the Photosensitive Material (B), respectively.

Photosensitive Material (F) (invention)

A photosensitive material having the same formulation as that of Photosensitive Material (B) except that 0.056 g/m$^2$, 0.067 g/m$^2$, and 0.052 g/m$^2$ of Compound (11) were further added to the first layer, third layer, and fifth layer of Photosensitive Material (B), respectively.

Photosensitive Material (G) (invention)

A photosensitive material having the same formulation as that of Photosensitive Material (A) except that 0.041 g/m$^2$, 0.054 g/m$^2$, and 0.052 g/m$^2$ of Compound (34) were further added to the first layer, third layer, and fifth layer of Photosensitive Material (A), respectively.

Photosensitive Material (H) (invention)

A photosensitive material having the same formulation as that of Photosensitive Material (B) except that 0.041 g/m$^2$, 0.058 g/m$^2$, and 0.062 g/m$^2$ of Compound (46) were further added to the first layer, third layer, and fifth layer of Photosensitive Material (B), respectively.

Photosensitive Material (I) (invention)

A photosensitive material having the same formulation as that of Photosensitive Material (A) except that 0.060 g/m$^2$, 0.041 g/m$^2$, and 0.071 g/m$^2$ of Compound (56 ) were further added to the first layer, third layer, and fifth layer of Photosensitive Material (A), respectively.

Photosensitive Material (J) (invention)

A photosensitive material having the same formulation as that of Photosensitive Material (A) except that 0.072 g/m$^2$, 0.081 g/m$^2$, and 0.092 g/m$^2$ of Compound (75) were further added to the first layer, third layer, and fifth layer of Photosensitive Material (A), respectively.

Photosensitive Material (K) (invention)

A photosensitive material having the same formulation as that of Photosensitive Material (B) except that 0.090 g/m$^2$, 0.072 g/m$^2$, and 0.068 g/m$^2$ of Compound (86 ) were further added to the first layer, third layer, and fifth layer of Photosensitive Material (B), respectively.

Photosensitive Material (L) (invention)

A photosensitive material having the same formulation as that of Photosensitive Material (a) except that 0.023 g/m$^2$, 0.023 g/m$^2$, and 0.024 g/m$^2$ of Compound (91) were further added to the first layer, third layer, and fifth layer of Photosensitive Material (A), respectively.

Photosensitive Material (M) (invention)

A photosensitive material having the same formulation as that of Photosensitive Material (A) except that 0.060 g/m$^2$, 0.052 g/m$^2$, and 0.062 g/m$^2$ of Compound (101) were further added to the first layer, third layer, and fifth layer of Photosensitive Material (A), respectively.

Photosensitive Material (N) (invention)

A photosensitive material having the same formulation as that of Photosensitive Material (B) except that 0.042 g/m$^2$, 0.046 g/m$^2$, and 0.032 g/m$^2$ of Compound (112) were further added to the first layer, third layer, and fifth layer of Photosensitive Material (B), respectively.

Photosensitive Material (O) (invention)

A photosensitive material having the same formulation as that of Photosensitive Material (A) except that 0.049 g/m$^2$, 0.047 g/m$^2$, and 0.037 g/m$^2$ of Compound (113) were further added to the first layer, third layer, and fifth layer of Photosensitive Material (A), respectively.

Photosensitive Material (P) (for comparison)

A photosensitive material having the same formulation as that of Photosensitive Material (A) except that 1.692 g/m$^2$, 1.731 g/m$^2$, and 1.655 g/m$^2$ of Compound (36) were further added to the first layer, third layer, and fifth layer of Photosensitive Material (A), respectively.

Photosensitive material (Q) (for comparison)

A photosensitive material having the same formulation as that of Photosensitive Material (A) except that 1.621 gm$^2$, 1.501 g/m$^2$, and 1.808 g/m$^2$ of Compound (1) were further added to the first layer, third layer, and fifth layer of Photosensitive Material (A), respectively.

A gradation exposure for sensitometry was applied to each of these photosensitive materials through a red, green, or blue filter with a sensitometer (an FWH type having a color temperature of light source of 3.200° K., a product of Fuji Photo Film Co., Ltd.). The exposure was carried out so that an exposure of 250 CMS can be obtained at an exposure time of 0.5 second.

Next, as in Example 1, the photosensitive material after being exposed was processed by processing A and processing B, respectively, and the resulting photosensitive material was evaluated for the photographic properties as follows.

Each density of yellow (Y), magenta (M), and cyan (C) of the thus processed sample was measured with each monochromatic light of blue, green, and red. As in Example 1, an exposure necessary to obtain a color density of 2.0 of yellow (Y) for a sample when processed by processing A was determined in advance and then a color density ($D^Y$) of yellow (Y) of a sample to which the same exposure as determined above had been applied and which was processed by processing B was determined. Herein, a scale, that is, the $S^Y$ of each sample was defined by the following formula (1).

$$S^Y \text{ value} = \frac{D^Y}{2.0} \quad (1)$$

By the same method as the above, the $S^M$ value and the $S^C$ value for magenta (M) and for cyan (C), respectively were defined and determined as follows:

$$S^M \text{ value} = \frac{D^M}{2.0} \quad (2)$$

$$S^C \text{ value} = \frac{D^C}{2.0}. \quad (3)$$

The results obtained are shown in Table 3.

TABLE 3

| | Surface active agents used in invention | | | | | | | | |
|---|---|---|---|---|---|---|---|---|---|
| | Compound | | Compound | | Total amount (A) of surface active | Weight ratio of (A) | | | |
| Sample | Type | Total amount in photosensitive material (g/m²) | Type | Total amount in photosensitive material (g/m²) | agents of invention in photosensitive material (g/m²) | to total amount of couplers in photo-sensitive material | $S^Y$ value | $S^M$ value | $S^C$ value |
| (A)* | (35) | 0.122 | — | — | 0.122 | 0.080 | 0.77 | 0.91 | 0.83 |
| (B)* | (36) | 0.122 | — | — | 0.122 | 0.080 | 0.76 | 0.90 | 0.82 |
| (C) | (35) | 0.175 | — | — | 0.175 | 0.115 | 0.85 | 0.95 | 0.91 |
| (D) | (35) | 1.810 | — | — | 1.810 | 1.187 | 0.91 | 0.97 | 0.92 |
| (E) | (36) | 0.122 | (2) | 0.162 | 0.284 | 0.187 | 0.91 | 0.97 | 0.95 |
| (F) | (36) | 0.122 | (11) | 0.175 | 0.297 | 0.195 | 0.95 | 0.98 | 0.98 |
| (G) | (35) | 0.122 | (34) | 0.147 | 0.269 | 0.177 | 0.87 | 0.96 | 0.94 |
| (H) | (36) | 0.122 | (46) | 0.161 | 0.283 | 0.186 | 0.94 | 0.98 | 0.96 |
| (I) | (35) | 0.122 | (56) | 0.172 | 0.294 | 0.193 | 0.94 | 0.96 | 0.94 |
| (J) | (35) | 0.122 | (75) | 0.245 | 0.367 | 0.241 | 0.92 | 0.96 | 0.93 |
| (K) | (36) | 0.122 | (86) | 0.230 | 0.352 | 0.232 | 0.96 | 0.96 | 0.94 |
| (L) | (35) | 0.122 | (91) | 0.070 | 0.192 | 0.126 | 0.92 | 0.97 | 0.93 |
| (M) | (35) | 0.122 | (101) | 0.174 | 0.296 | 0.195 | 0.93 | 0.96 | 0.93 |
| (N) | (36) | 0.122 | (112) | 0.120 | 0.242 | 0.159 | 0.93 | 0.96 | 0.95 |
| (O) | (35) | 0.122 | (113) | 0.133 | 0.255 | 0.168 | 0.92 | 0.95 | 0.94 |
| (P)* | (35) | 0.122 | (36) | 5.078 | 5.200 | 3.42 | 0.79 | 0.94 | 0.68 |
| (Q)* | (35) | 0.122 | (1) | 4.930 | 5.052 | 3.32 | 0.76 | 0.91 | 0.67 |

(Note) *comparative sample

Table 3 clearly shows that, as in Example 1, even if Photosensitive Materials (C) to (O) of the invention are processed with color developing solution (B) containing no benzyl alcohol, they show performance equal to or approximating that they show when processed with color developing solution (A) containing benzyl alcohol, different from Photosensitive Materials (A), (B), (P), and (Q) for comparison.

Further, as a result of analysis, it has been confirmed that any of the photosensitive materials of the invention has an increased dye density corresponding to the same developed silver amount, as compared with the photosensitive materials for comparison. This fact suggests that use of the compound in accordance with this inention in an amount prescribed according to this invention results in a substantially elevated activity of couplers in the photosensitive material.

Photosensitive Materials (P) and (Q) for comparison each using the surface active agent in an amount exceeding the range prescribed in the invention had problems that not only were they inferior to the photosensitive materials of this invention in color development properties but also they had sticky surfaces and provided unclear color images. Further, it has been confirmed that a cyan dye in Photosensitive Materials (P) and (Q) forms a leuco dye as a cause for lowering in their color development properties.

By carrying out this invention, it becomes possible to use substantially no benzyl alcohol, and, as a result, the environmental polution load can be reduced, preparation work for a color developing solution can be alleviated, and a lowering in a dye density caused by a cyan dye existig in a leuco form can be avoided. By use of the surface active agent of the invention, high color development of photosensitive material can be obtained without the use of benzyl alcohol.

While the invnetion has been described in detail and with reference to specific embodiments thereof, it will be apparent to one skilled in the art that various changes and modifications can be made therein without departing from the spirit and scope thereof.

What is claimed is:

1. A method for forming a color image which comprises imagewise exposing a color photographic material comprising a reflective support having thereon at least one photosensitive layer containing a color coupler capable of forming a dye image through its coupling reaction with an oxidation product of aromatic primary amine color developing agent and a silver halide emulsion and processing it with a color developing solution containing substantially no benzyl alcohol, wherein the color development is carried out under the condition that at least one substantially anionic surface active agent having an unsubstituted aliphatic group, a substituted aliphatic group excluding a fluorine-substituted aliphatic group, or an unsubstituted or substituted aromatic group as a hydrophobic group and $-SO_3M$, $-SO_2M$, $-OSO_3M$, or $-OSO_2M$, wherein M represents a hydrogen atom or a metallic atom or atomic group capable of being a cation, as a hydrophilic group in the molecule thereof is present in a total amount within a range of from 0.1 to 3 times the total weight of the color couplers applied in the photosensitive layer during the color development, and wherein said anionic surface active agent comprises at least one compound represented by formula (IV)

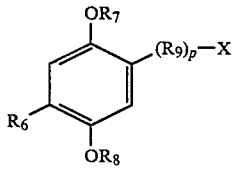

(IV)

wherein $R_6$ represents a substituted or unsubstituted alkyl, alkoxy, aromatic or alkylthio group containing 6 or more carbon atoms; $R_7$ and $R_8$ each represents a hydrogen atom or an alkyl group containing from 1 to 18 carbon atoms; $R_9$ represents an alkylene group containing from 1 to 4 carbon atoms; p represents 0 or 1; and X represents $-SO_3M$, $-SO_2M$, $-OSO_3M$, or —$OSO_2M$, wherein M represents a hydrogen atom or a metallic atom or atomic group capable of being a cation.

2. A method for forming a color image as set forth in claim 1, where the amount of the anionic surface active agent present in the photosensitive layer during the color development is within a range of from 0.15 to 2.5 times the total weight of the color couplers.

3. A method for forming a color image as set forth in claim 1, wherein the amount of the anionic surface active agent present in the photosensitive layer during the color development is within a range of from 0.2 to 2 times the total weight of the color couplers.

4. A method for forming a color image as set forth in claim 1, wherein the at least one anionic surface active agent further comprises a compound represented by formula (I)

$$R_1-(CH_2CH_2O)_m(CH_2)_n-(X)_l \quad (I)$$

wherein $R_1$ represents a hydrogen atom or a substituted or unsubstituted alkyl, aryl, alkoxy, aryloxy, alkylthio, or arylthio group, provided that said group is not a fluorine-substituted alkyl group or a fluorine-substituted alkoxy group; X represents —$SO_3M$, —$SO_2M$, —O-$SO_3M$, or —$OSO_2M$, wherein M represents a hydrogen atom or a metallic atom or atomic group capable of being a cation; m and n each represents an integer of from 0 to 30; and l represents 1 or 2.

5. A method for forming a color image as set forth in claim 1, wherein the at least one anionic surface active agent further comprises a compound represented by formula (II)

$$R_2-\underset{\underset{O}{\|}}{C}-\underset{\underset{R_3}{|}}{N}-(CH_2CH_2O)_m(CH_2)_n-X \quad (II)$$

wherein $R_2$ and $R_3$ each represents a hydrogen atom or a substituted or unsubstituted alkyl or aryl group, provided that $R_2$and $R_3$ are not both hydrogen atoms and that $R_2$ is not a fluorine-substituted alkyl group; X represents —$SO_3M$, —$SO_2M$, OR —$OSO_2M$, wherein M represents a hydrogen atom or a metallic atom or atomic group capable of being a cation; and m and n each represents an integer of from 0 to 30.

6. A method for forming a color image as set forth in claim 1, wherein the at least one anionic surface action agent further comprises a compound represented by formula (III)

$$\begin{array}{l} \quad CH_2COOR_5 \\ X-CHCOOR_4 \end{array} \quad (III)$$

wherein $R_4$ and $R_5$ each represents a hydrogen atom or a substituted or unsubstituted alkyl, aryl, or aralkyl group, provided that $R_4$ and $R_5$ are not both hydrogen atoms and that neither $R_4$ nor $R_5$ is a fluorine-substituted alkyl group; and X represents —$SO_3M$, —$SO_2M$, —O-$SO_3M$, or —$OSO_2M$, wherein M represents a hydrogen atom or a metallic atom or atomic group capable of being a cation.

7. A method for forming a color image as set forth in claim 1, wherein the anionic surface active agent further comprises at least one compound selected from the group consisting of the compounds represented by formulae (I), (II) and (III)

$$R_1-(CH_2CH_2O)_m(CH_2)_n-(X)_l \quad (I)$$

$$R_2-\underset{\underset{O}{\|}}{C}-\underset{\underset{R_3}{|}}{N}-(CH_2CH_2O)_m(CH_2)_n-X \quad (II)$$

$$\begin{array}{l} \quad CH_2COOR_5 \\ X-CHCOOR_4 \end{array} \quad (III)$$

wherein $R_1$ represents a hydrogen atom or a substituted or unsubstituted alkyl, aryl, alkoxy, aryloxy, alkylthio, or arylthio group, provided that said group is not a fluorine-subsituted alkyl group or a fluorine-substituted alkoxy group; $R_2$ and $R_3$ each represents a hydrogen atom or a substituted or unsubstituted alkyl or aryl group, provided that $R_2$ and $R_3$ are not both hydrogen atoms and that $R_2$ is not a fluorine-substituted alkyl group; $R_4$ and $R_5$ each represents a hydrogen atom or a substituted or unsubstituted alkyl, aryl, or aralkyl group, provided that $R_4$ and $R_5$ are not both hydrogen atoms and that neither $R_4$ nor $R_5$ is a fluorine-substituted alkyl group; X represents —$SO_3M$, —$SO_2M$, —O-$SO_3M$, or —$OSO_2M$, wherein M represents a hydrogen atom or a metallic group or atomic group capable of being a cation; m and n each represents an integer or from 0 to 30; and l represents 1 or 2.

8. A method for forming a color image as set forth in claim 1, wherein the compound represented by formula (IV) is used in an amount within the range of from 0.05 to 0.20 times the total weight of the color couplers applied in the photosensitive layer during color development.

9. A method for forming a color image as set forth in claim 4, wherein the compound represented by formula (I) is used in an amount within the range of from 0.01 to 0.4 times the total weight of the color couplers applied in the photosensitive layer during color development.

10. A method for forming a color image as set forth in claim 5, wherein the compound represented by formula (II) is used in an amount within the range of from 0.01 to 0.4 times the total weight of the color couplers applied in the photosensitive layer during color development.

11. A method for forming a color image as set forth in claim 6, wherein the compound represented by formula (III) is used in an amount within the range of from 0.01 to 0.4 times the total weight of the color couplers applied in the photosensitive layer during color development.

* * * * *